US008251879B2

(12) United States Patent
Binns et al.

(10) Patent No.: US 8,251,879 B2
(45) Date of Patent: Aug. 28, 2012

(54) SHOULDER REHABILITATION AND EXERCISE DEVICE

(76) Inventors: Matthew Binns, Chicago, IL (US); Eugene David Protas, League City, TX (US); Scott Avenarius, Cary, IL (US)

( * ) Notice: Subject to any disclaimer, the term of this patent is extended or adjusted under 35 U.S.C. 154(b) by 0 days.

(21) Appl. No.: 13/134,361

(22) Filed: Jun. 6, 2011

(65) Prior Publication Data

US 2011/0230800 A1 Sep. 22, 2011

Related U.S. Application Data

(63) Continuation-in-part of application No. 12/156,199, filed on May 30, 2008, now Pat. No. 7,976,444.

(60) Provisional application No. 60/941,168, filed on May 31, 2007.

(51) Int. Cl.
*A63B 21/008* (2006.01)

(52) U.S. Cl. ..... 482/112; 482/92; 482/904; 601/33

(58) Field of Classification Search ..... 482/44, 482/92, 111–115, 133–139, 148, 904, 905, 482/908–910; 473/229, 258, 259; 601/5, 601/23, 33

See application file for complete search history.

(56) References Cited

U.S. PATENT DOCUMENTS

| | | | | | |
|---|---|---|---|---|---|
| 3,042,023 | A * | 7/1962 | Yates | 601/33 |
| 3,785,657 | A * | 1/1974 | Moller | 473/229 |
| 3,926,430 | A * | 12/1975 | Good, Jr. | 482/112 |
| 4,570,925 | A * | 2/1986 | Kock et al. | 482/46 |
| 4,603,856 | A * | 8/1986 | Fiore | 482/114 |
| 4,772,015 | A * | 9/1988 | Carlson et al. | 482/92 |
| 4,817,943 | A * | 4/1989 | Pipasik | 482/97 |
| 4,957,281 | A * | 9/1990 | Christolear, Jr. | 482/100 |
| 5,125,844 | A * | 6/1992 | Grant et al. | 434/252 |
| 5,645,521 | A * | 7/1997 | Hepburn et al. | 601/33 |
| 5,713,370 | A * | 2/1998 | Cook | 600/595 |
| 7,491,158 | B1 * | 2/2009 | Danaei-Boroumand | 482/110 |
| 7,621,857 | B2 * | 11/2009 | Pompile | 482/129 |
| 2002/0107116 | A1 * | 8/2002 | Schulz | 482/97 |
| 2006/0293617 | A1 * | 12/2006 | Einav et al. | 601/33 |
| 2008/0153682 | A1 * | 6/2008 | Chen et al. | 482/136 |

* cited by examiner

*Primary Examiner* — Loan Thanh
*Assistant Examiner* — Daniel F Roland
(74) *Attorney, Agent, or Firm* — Richard L. Strauss, esq.

(57) ABSTRACT

A shoulder rehabilitation and exercise device is disclosed which enables a user to perform internal and external rotations of both right and left shoulder. The device is comprised of a base plate, hydraulic damper, restrictor arm, actuator arm, elbow cup and hand grip. A smooth, fluid-like movement is achieved during performance of arcuate internal and external shoulder rotations while also providing automatic increases and decreases in resistance to such motion in response to user effort. In certain preferred embodiments, in addition to such automatic adjustment of resistance, the device includes a means of manually adjusting resistance. The device may be utilized to perform the aforementioned internal and external rotations on a user's right or left side without need for making any adjustments to the machine. Range of motion limitations may be set to control the arcuate degree of internal and external rotations performed. Adjustment in the elevation of a user's forearm via adjustment of a two section, pivoting base plate is provided that enables elevation adjustment without effecting operating resistance. The actuator arm includes an adjustable elbow cup and adjustable hand grip. The device does not store potential energy or produce sufficient momentum to oppose a user's immediate and safe termination of motion.

18 Claims, 14 Drawing Sheets

SHOULDER REHABILITATION AND EXERCISE DEVICE

RELATED APPLICATIONS

This application is a continuation-in-part application based upon U.S. patent application Ser. No. 12/156,199 filed May 30, 2008 now U.S. Pat No. 7,976,444 which, in turned, claimed the benefit of U.S. Provisional Application No. 60941168 filed on May 31, 2007, the contents of which prior applications are hereby incorporated by reference.

TECHNICAL FIELD

The present invention relates to the field of rehabilitation and exercise equipment. More specifically, a rehabilitation and exercise device is disclosed herein specifically adapted and configured to enable a user to strengthen and increase the range of motion of muscles associated with internal and external rotation of the shoulder.

BACKGROUND OF THE ART

The shoulder joint is the most mobile and flexible joint in the human body. This joint controls the position of the upper arm and, due to the high flexibility of the joint, enables a tremendous range of motion. However, due largely to its high flexibility, the shoulder is frequently subject to injury leading to pain, inflammation and loss of motion. The humerus and the scapula are the two major components of the shoulder joint with a portion of the head of the humerus functioning substantially as a ball positioned in a rather shallow cup-like area of the scapula known as the glenoid fossa. Smooth articular cartilage covers both the head of the humerus and the glenoid fossa and, together with the action of synovial fluid, allows these surfaces to glide with little friction. The joint capsule comprised of strong ligaments connects the head of the humerus to the scapula at the glenoid fossa so as to both secure and help define the joint and resist dislocation.

Muscles attached to different parts of the shoulder are utilized to enable the upper arm to move. The deltoid is a large muscle attached medially to the scapula along the acromion and also attached to a portion of the clavicle. The lateral portion of the muscle crosses the shoulder joint and is attached to the humerus about halfway down its length. The deltoid is the strongest of the shoulder muscles. Its function is to raise the arm upward (or abduction).

Internally disposed in relation to the deltoid muscle, a group of muscles known as the "rotator cuff" helps stabilize the joint as well as enable further movements of the arm. More specifically, the rotator cuff is a group of four muscles forming a strong "cuff" about the joint formed by the head of the humerus and glenoid fossa. In addition to helping to stabilize this joint, these muscles provide rotation and stabilize position of the arm. The four muscles of the rotator cuff are the subscapularis; supraspinatus; infraspinatus and teres minor.

The subscapularis muscle is attached to the deep surface of the scapula and then passes in front of the humeral head. It inserts into the humerus at the lesser tuberosity. This muscle is used to internally rotate the shoulder (and arm) and to bring the arm down to the side of the body (a motion that is called "adduction"). Ordinarily, internal rotation of the shoulder, or abduction, results in rotation of the arm so that the palmar surface of the hand turns away from the body as the dorsum of the hand approaches the trunk. For example, internal rotation of the right shoulder ordinarily results in a counter-clockwise rotation of the right hand and internal rotation of the left shoulder results in a clock-wise rotation of the left hand.

The three remaining muscles of the rotator cuff each have medial insertions at posterior surface of the scapula and then extend posterior to the humeral head where each continue on to insert at the greater tuberosity of the humerus. Such insertions and path enable these muscles to externally rotate the shoulder (and, in regard to supraspinatus) abduct (or move the arm outward, away from the side of the body).

Each of the muscles of the rotator cuff are susceptible to injury such as sprains and muscle tears which can be debilitating. The supraspinatus muscle and tendon is especially susceptible to such injury and is the most commonly injured part of the rotator cuff due, in large part, to its position and path of contraction. However, any of these muscles and associated tendons can an are involved in rotator cuff injuries.

It is known that strengthening the rotator group of muscles through exercise can greatly reduce the chance of rotator cuff injury and/or re-injury. For this reason, it is also well known to perform internal and external rotations of the shoulder to keep these muscles in top condition. Such exercise is also utilized as part of rehabilitation programs for treatment of rotator cuff injuries. More specifically, such rehabilitation programs often progress from passive range of motion exercises to active-assisted range of motion exercise to strengthening exercises.

Mastectomy patients often suffer shoulder pain related to cervical radiculopathy. Such underlying conditions may be exacerbated by the surgical procedures. Nonetheless, post operative shoulder pain is quite common in breast cancer patients during all phases of the disease.

Radiculopathy may present as pain, paresthesias, numbness, or weakness of the shoulder, arm, and/or hand. In particular, upper cervical radiculopathy (C5 or C6) commonly radiates pain to the shoulder and upper arm and weakens the rotator cuff muscles, biceps, and deltoid. Shoulder pain/rotator cuff weakness can contribute to shoulder impingement and secondary adhesive capsulitis. Non-cancer-related cervical radiculopathy can be treated nonoperatively with physical therapy (PT), anti-inflammatory drugs, and nerve-stabilizing agents such as gabapentin. Malignant radiculopathy can respond to similar interventions but may also require chemotherapy, external beam radiation, or surgery. PT and occupational therapy (OT) can improve upper extremity strength, dexterity, coordination, activities of daily living, and shoulder range of motion (ROM) and decrease neck spasms. This is true even when symptoms are caused by cervical primary or metastatic cancer. In the absence of mechanical instability, significant epidural disease (which could result in spinal cord compression), or progressive neurologic deficits (an indicator of spinal cord or nerve root compression), therapeutic activities including active and passive ROM exercises are generally safe. Thus, it would be highly advantageous for such individuals to be provided with a safe and effective device for providing such ROM and shoulder strengthening exercises. (See Stubblefield M D, Custodio C M. Upper-extremity pain disorders in breast cancer. Arch Phys Med Rehabil 2006; 87(3 Suppl 1):S96-9.)

In the past, strengthening exercises for the rotator cuff muscles—including those used for rehabilitation and for prevention of injuries—included external rotation and internal rotation of the shoulder utilizing, for example, hand weights. Utilizing such weights, an individual might, for example lie on their side on the floor or a exercise bench with their upper arm parallel to their body and lower arm held 90 degrees in relation to the upper arm. Thereafter, the shoulder could be internally or externally rotated, while holding a weight, to perform resistive training.

Utilizing free weight exercise was of limited value in that, depending upon the user's position, it is difficult to obtain consistent resistance through, for example, a complete 180 degrees of internal or external rotation. A handheld weight, following an arch-like movement, will not provide consistent resistance. For example, when the user's shoulder is positioned so that the lower arm lies vertical (plumb), there is substantially no force exerted upon the rotator cuff muscles. However, as the shoulder rotates and the lower arm approaches a position parallel with the floor, the force provided by the weight acting upon the rotator cuff muscles will increase. Such exercises also require utilizing different barbells when greater or lesser resistance is required. Such techniques also make no allowance for control and achievement of a safe range of motion. Holding a free weight by hand, especially in regard to a rehabilitation exercise, may be dangerous in that the potential energy associated with the weight might cause a user to over-extend his or her movements —go beyond a range of motion in which such movement is safe—. Such free weight exercises make no provision for controlling range of motion (ROM). Also, if a user should suffer a spasm, sudden pain or lose consciousness, the potential energy stored in the free weight or the momentum developed could cause further injury to the user or others. In addition, performing both internal and external rotation of the shoulder with weights would most likely require a user to continually change position.

It has also been known, in the past, to utilize elastic bands and pulleys to exercise the muscles of the rotator cuff. More specifically, internal and external rotations of the shoulder have been accomplished utilizing an elastic band (or tube) fixed to a support, such as a door or pole. In such exercise, the individual may stand, sit or kneel, with her upper arm aligned with her torso and lower arm positioned at about 90 degrees in relation to the upper arm. Thereafter, the user grasps the free end of the tube or band and performs the desired rotation which is resisted by the elastic material. However, utilizing such an exercise device subjects a user to varying amounts of resistance as the band or tube is stretched and, similar to the use of weights, subjects the user to the danger of stored potential energy within the elastic posing a danger of injuring the user. Also, such elastics require the user to change position when he or she wishes to change from internal to external rotation exercises.

Pulley devices utilizing weights have also been known to be utilized for performing internal and external rotation shoulder exercises. However, as the case with hand weights and elastics, pulley machines also store potential energy during use which can result in the aforementioned injuries. Such machines also require a change in user position and/or machine configuration in order to perform both internal and external rotation exercises.

U.S. Pat. No. 4,878,663 discloses a rehabilitation and fitness apparatus which incorporates a range limiter disc. The disclosed device utilizes a rotating disc which is rotated through the action of an actuator arm. However, rather than using the range limiter disc to control the range of movement a user's shoulder could internally or externally rotate, the disclosed device uses the disc to set the actuator bar in a desired "start" position so as to enable one machine to be utilized to perform multiple exercises (such as internal and external shoulder rotation). The disclosed device utilizes a stack of weights to provide resistance to a user's motion which, of course, does entail the storing of potential energy and generation of momentum that can cause the aforementioned problems. The device does provide adjustment of resistance by the use of a pin to control the number of weights in the stack utilized.

U.S. Pat. No. 4,957,281 discloses a rotator cuff therapeutic exercise device which includes a stack of weights supported by a frame which are raised in a working stroke from a rest position, against gravitational force, to a raised position (with stored potential energy). An actuator mechanism on the frame is specifically shaped and configured to be gripped and rotated by the hand of a user to move the weights along the working stroke. The actuator mechanism may be adjusted to a first or second position for enabling a corresponding rotational working motion of the one of the user's arms whose hand grips the actuator mechanism. This device, as discussed above in regard to free weight exercise and elastic resistance machines, stores potential energy and develops considerable momentum which may be damaging to a user and includes no means of controlling the range of motion during inward or outward rotation. The machine also requires manual adjustment to change resistance.

U.S. Pat. No. 5,080,350 discloses a rehabilitation/exercise device wherein elevational adjustment is provided. However, the device disclosed in this patent provides no means to provide limitation to internal or external rotation of a shoulder. The subject device utilizes a brake and brake drum to provide resistance.

Ideally, a shoulder rehabilitation/exercise device should: a. enable an individual to perform internal and external rotations of the shoulder wherein the device: b. enable performance of inward and outward rotations of both the right and left shoulders without having to adjust the device or re-position the user; c. provide secure, stable, and adjustable positioning of a user's elbow; d. provide adjustment to accommodate arm's of varying length; e. provide adjustment of the angle formed between the upper and lower arm; f. provides a means of controlling the range of motion a user may operate the device during such operation; g. provide fluid-like resistance during exercise so as to prevent injury to the shoulder joint; h. exerts no substantial force which would otherwise continue movement of the device after a user has terminated operation thereof; I. enable adjustment of device resistance without having to manually adjust the device; and j. enable manual adjustment in regard to device resistance when such is advantageous.

U.S. patent application Ser. No. 12/156,199, (hereinafter referred to as "the '199 application") discloses, a highly portable shoulder rehabilitation and exercise device requiring no external source of power and which is operated by the physical effort of a user alone. Operation of the device enables a user to accomplish both internal (inward) and external (outward) rotations of both the right and left shoulder joint—without having to adjust the device or the user's position—while providing smooth, fluid-like operation. The device disclosed in U.S. patent application Ser. No. 12/156,199 enables a user to suddenly terminate such rotation without potential energy or momentum generated by the device being sufficient enough to oppose such termination. The disclosed device also provides secure, stable retention of a user's elbow while also providing adjustment to accommodate arms of varying dimensions and enabling setting forth a desired angular relation between a user's upper and lower arm. However, the means utilized to adjust the angular relation of a user's upper and lower arm disclosed in U.S. patent application Ser. No. 12/156,199 necessarily changes the amount of force required to operate the device (at a given rate of speed) due to the effect of such adjustment lengthening or shortening the moment arm—or the effective length of the lever—of the below described actuator arm. The device disclosed in U.S. patent application Ser. No. 12/156,199 also enables positive limitation of the range of inward and outward rotation of a user's shoulder during use of the device. Also, the device enables smooth, fluid-like resistance to internal or external rotation which is automatically increased as a user applies greater force to internal and external rotations. In certain preferred embodiments of the '199 application, the device includes a means to manually vary resistance to internal and external rotation while also automatically adjusting resistance in accordance with the force applied by a user. It would be highly advantageous if a shoulder exercise/rehabilitation device could be disclosed which incorporated all of the advantages provided by the '199 device, such as, for instance:

1. providing inward and outward resistance exercises for the shoulder with fluid like motion;

2. enabling a user to stop exercise motion without having to overcome stored potential energy;

3. providing positive range of motion measurements/stops; and 4. providing adjustable resistance while, at the same time, providing the ability to change the relative elevation of the actuator arm to which a user applies force—without such changes in elevation causing a change in the effort necessary to move the actuator arm at any given speed. To put it simply, the shoulder exercise/rehabilitation device of the '199 patent enables a user to change the elevation of the disclosed actuator arm in order to provide a desired angular relationship of the upper and lower arm of a user (or to accommodate the height of a user's chair or table). That device provides elevation changes via a pivoting relationship between the actuator arm which a user grips with his/her hand, and the restrictor arm which connects the actuator arm with a rotary damper. Such elevation, as discussed below, necessarily shortens the distance between the point along the length of the actuator arm where an operator grips the grip handle and the longitudinal axis of rotation—thus decreasing the distance between the point of force application (the hand grip) and the longitudinal axis of rotation. Thus, as the actuator arm of the '191 application rises, the effective leverage provided by the arm decreases and the amount of torque required to operate the device increases. Therefore, the '191 device is unable, without the use of additional adjustments, to provide a uniform resistance for a user as the elevation of the actuator is adjusted to accommodate a particular user's arm dimensions or the height of a table and/or chair utilized when operating dame. What is needed is a means of changing the relative elevation of the actuator arm in relation to the planar surface of the surface to which the device is affixed, without effecting and/or changing the effective length of the lever arm provided by the actuator arm.

SUMMARY OF THE INVENTION

Now in accordance with the present invention, an exercise/rehabilitation device is disclosed which is comprised of a two section base plate, a hydraulic damper, a restrictor arm, an actuator arm, an elbow cup and a hand grip. The term "restrictor arm" and "transfer arm" as utilized within this application and within the claims both refer to the same elemental bar which is affixed to the central axle of the damper and is used as a means of transfer torsional force from the actuator arm to the central axle of the hydraulic damper as well as a means for engaging restrictor pins for limitation of the arcuate motion of the actuator arm. Also, the terms "restrictor bar" and "transfer bar" as well as the terms actuator arm and "actuator bar" refer to the same to elements, the terms"arm" for "bar" being equivalent terms.

The exercise and rehabilitation device of the present invention utilizes a two section base plate comprised of a proximal and distal section. The proximal and distal sections each include an upper and lower broad planar surface, a proximal end, distal end, a right and left side. In preferred embodiments of the present invention, the proximal section of the base plate is pivotally joined to the distal section by means of a hinge joint located at the distal end of the proximal section and proximal end of the distal section. The hinge joint may be advantageously formed, for example, utilizing a barrel hinge configuration. The base plate is provided with a plurality of bores therethrough. The bores formed in the proximal section of the base plate includes a central axle bore which passes through both the upper and lower surface of the plate especially configured and shaped for passage of the central axle of the hydraulic damper, discussed below. In addition, the proximal section of the base plate includes restrictor bores especially shaped and configured—in an arcuate pattern—for the receipt and retention of restrictor pins also discussed in more detail, below.

The distal section of the base plate includes a means for the stabilization and affixation of the device to a stable surface. For example, the distal section of the base plate, in certain preferred embodiments, includes a plurality of screw clamp devices extending downward from, and positioned perpendicular to the lower surface of the base plate. Such clamps are utilized to stabilize and mount the device to a flat stable surface such as, for example, a table. For this purpose, it is preferred that at least two such clamp devices are provided. However, three or more of such clamps may be provided for securing the device to, for example, a table top. When, as described below, certain preferred embodiments of the device are configured for mounting the device to the corner of the table top, it is even further preferred that four such screw clamps are provided. In such embodiments, each screw clamp is affixed to the lower surface of the distal base plate section within further bores especially configured to receive same. The bores may be threaded to engage a matingly threaded distal portion of a stud member of a screw clamp. However, the bore may be smooth for receipt of a pressed-in stud. A sliding clamp may be advantageously mounted upon the stud and held upon the stud by a nut such as, for example, a wing nut. Rotation of the wingnut along the stud adjusts the sliding clamp upward (towards the base plate so as to mount the plate to an intervening mounting surface) or downward (so as to release the device from a mounting surface.) In addition to the aforementioned integral screw clamp stabilization means, the device of the present invention also contemplates the use of ordinary external screw clamps to stabilize the device to stable surfaces such as, for example, table tops, chairs and door frames. However, regardless of the specific means of affixation of the device to a supporting service, it is the distal section of the base plate that is secured, rather than the proximal service. The distal service is also secured in such a position so that the hinge joint affixing the proximal and distal sections of the base plate can freely pivot without interference from the supporting surface.

In alternate preferred embodiments of the exercise and rehabilitation device of the present invention, the distal section of the base plate may also utilize weights, or be formed of higher weight materials as a means for stabilizing the device during use. In such embodiments, it is preferable to utilize a distal section of the base plate having an adherent lower surface so that the effect of the weight in combination with the adherent lower surface acts to stabilize the device. For example, the lower surface of the distal section of the base plate may be covered with a rubber material such as, for example, a nitrile rubber, a natural rubber, a polythioether rubber or a silicon rubber. Covering or forming the lower surface of the device with such high friction compositions and materials tends to increase the coefficient of friction between the lower surface of the distal section of the base plate and, for example, a table top upon which the device might be placed. The increased friction of such distal section lower base plate surface in combination with the use of a weighted base provides a means of temporarily stabilizing the device for use. Straps, including those utilizing hook and loop fasteners applied to the distal section of the two piece base plate may also be utilized to temporarily position the device to a stable object for use thereof. Hook and loop fastening material may also be applied to the lower surface of the distal portion of the base plate with a mating hook and loop fastening material applied to a table, desk, chair or doorway to provide temporary mounting of the device. Bores penetrating the upper and lower surfaces of the distal section of the base plate may also be utilized to receive bolts, screws and other like fasteners for more permanent mounting of the device to, for example, a table, chair, desk or doorway. However, regardless of the type of mounting means utilized, all such means are utilized to secure the distal section of the base plate while allowing the proximal section to freely pivot, as described in detail, below.

The hydraulic damper utilized in the device of the present invention provides the above and below described smooth, fluid-like resistance to arcuate movement of the actuating arm while enabling the device to stop immediately in reaction to a user's cessation of application of force to the device. The hydraulic damper is mounted to the lower surface of the proximal section of the base plate and includes a central axle having a proximal terminus, a distal terminus and a longitudinal axis. In preferred embodiments of the present invention, the central axle is oriented and positioned so that the longitudinal axis thereof is perpendicular to the horizontal planes formed by the upper and lower planar surfaces of the proximal section of the base plate.

The diametric center of the longitudinally oriented central axis which engages the restrictor arm, which, in turn, is affixed to the proximal end of the actuator arm—as described below—, forms one terminus of the lever arm created between the central axis and that point along the actuator arm where the hand grip is inserted. As discussed above and below, due to this orientation, when adjusting the elevation of the actuator arm in accordance with the device disclosed in the '191 application, a change occurs in regard to the effective length of the lever arm. Such changes naturally alter the amount of force required, at any given speed, to rotate the actuator arm.

The term "fluid-like resistance" as utilized throughout this application and the claims (as well as in describing and claiming the devices disclosed in the '199 application), refers to the smooth, continuous and evenly applied resistance generated by the device and applied in opposition to a user's efforts to bias the actuator arm in the above-described arc-like motion during use of the device. Thus, the rehabilitation and exercise device of the present invention provides smooth, even and continuous resistance during use, but, at the same time, increase and decreases such resistance in response to a user's acceleration or deceleration of device operation, respectively. Such fluid like resistance is delivered as an even and continuous opposing force void of any pulsatile nature. In addition, such resistance generated by the device terminates upon cessation of application of force to the device by a user.

In certain preferred embodiments of the present invention, the hydraulic damper is a rotary vane displacement damper that enables both clockwise and counterclockwise rotation which is transferred from the actuator arm, through the restrictor arm and thence to the central axle of the damper. It is preferred that such dampers provide at least 90 degrees of clockwise and 90 degrees of counterclockwise rotation so as to provide a total, at a minimum of 180 degrees of rotation.

In preferred embodiments of the present invention, the rotary damper includes, for example, a mounting plate, a main housing with a fin(s) extending radially and inward therefrom, a central axle upon which a rotor is mounted and hydraulic fluid. In preferred embodiments of the present invention, the hydraulic damper is mounted upon the lower surface of the proximal section of the two section base plate via a damper mounting plate via associated bolts or any other reliable means such as, for example, rivets, screws or bonding. The hydraulic damper is mounted and positioned upon the proximal section of the base plate so that the central axle of the damper extends through the upper planar surface of the base plate perpendicular to the horizontal planes formed by the upper and lower broad planar surfaces of the proximal section of the base plate.

In certain preferred embodiments of the present invention, the damper includes a manually adjustable hydraulic fluid flow valve which can be operated by a user in order to select a higher or lower range of damper resistance. That is to say, the damper utilized in all embodiments of the present invention provides—automatically—an increase in resistance to arcuate motion of the restrictor arm in response to increased application of force—and thus an increase in acceleration—applied to the hand grip of the actuator arm by a user. Conversely, the damper utilized in all embodiments of the present invention provides a decrease in resistance in response to a decreased application of force—and thus a decrease in restrictor arm acceleration—applied to the hand grip by a user. The resistance of such dampers, from the lowest to highest responsive resistance defines a range of resistance. Certain preferred embodiments of the present invention utilize a damper having an adjustable hydraulic valve which is operable by a user (as described below) enables an increase or decrease in the range of automatic resistance provided by the damper.

In embodiments of the present invention utilizing rotary dampers, controlled clearances between a vane(s) extending from the rotating rotor and radially disposed vanes extending inward from the housing causes—upon rotation of the rotor—controlled flow of hydraulic fluid therebetween. The controlled flow created by these fins limits the speed of displacement of hydraulic fluid from one side of the rotor fin(s) to the other when the shaft upon which the rotor is mounted is rotated. Thus, such controlled flow provides the damping function of the rotary damper (also referred to herein, and, in generally, by the art, as a dashpot).

In certain preferred embodiments of the present invention, in addition to such controlled clearances, a hydraulic flow valve—or, as it may also be referred to as—an adjuster—which provides further control of the displacement of hydraulic fluid caused by the turning of the rotor. Such valves may effectively increase and effectively decrease the restrictive effect of the damper vanes to fluid flow (and thus shaft rotation) by providing the hydraulic fluid contained within the damper with a further pathway or, in some embodiments, control of existing fluid pathways. Such valves may, for example, provide an aperture through which hydraulic fluid, acted upon by the vane of a rotating rotor, may flow. The apertures of these valves—in embodiments of the present invention providing adjustable resistance—may be increased or decreased so as to reduce or increase the force required to force fluid therethrough respectively. For this purpose, such embodiments may, for example, utilize an adjustment pinion which, in turn, is operated by a resistance adjustment wheel to enable a user to manually operate the valve in regard to control the aperture.

As discussed in detail, below, the restrictor and actuator arms rotate upon the central axle of the damper—which extends superior to and is, in effect, the distal extension of the rotor shaft. Decreasing the hydraulic fluid flow valve aperture will cause an increase in the resistance provided by the damper to these arms which will, in turn, oppose inward and outward rotation of the actuator arm. Simply put, and as is well known to the art of hydraulic dynamics, more force is necessary to cause the same volume of hydraulic fluid through a smaller aperture at a given time period. Conversely, increasing the aperture will decrease resistance to rotation.

It is preferred that the hydraulic damper utilized in preferred embodiments of the present invention generate a rotational resistance from about 0.5 to about 80 Nm/radian/s. It is still further preferred that the damper generate a rotational resistance of from about 2 to about 40 Nm/radian/s. Such resistance enables a user to gently perform internal and external rotations with diminimus resistance while increasing flexibility and range of motion. At the same time, the higher end of this range of resistance enables a user to apply greater biasing force—lateral force applied to the device through the handgrip which causes the actuator arm to follow internal and external arcuate movement—so as to thoroughly work and strengthen the associated muscles.

A hydraulic damper, well suited for use in the exercise/rehabilitation device of the present invention is the model LA Dashpot manufactured by Kinetrol, LTD, Trading Estate, Surrey, England GUN 9NU. This hydraulic damper is a vane displacement unit wherein a vane on the shaft rotates past fixed vanes on the body of the unit. This damper provides 215 degrees of rotation. It is preferred that any rotary damper utilized in practicing the present invention demonstrate, at minimum, 180 degrees of rotation.

The restrictor arm (also referred throughout this specification and claims as the transfer arm) with the same and equal meaning—is configured, in certain preferred embodiments, as an elongated bar having a proximal terminus, a distal terminus, a longitudinal axis extending therebetween, an upper surface, a lower surface as well as right and left side surfaces. The restrictor arm is mounted, (at the lower surface thereof) upon the central axle of the hydraulic damper. The mounting of the restrictor arm upon the central axle of the rotary hydraulic damper provides, in essence, a pivoting bar formed and rotating about and perpendicular to the longitudinal axis of the central axle. In operation of the device, discussed in more detail, below, the transfer arm moves along an arcuate path which is parallel and superior to the horizontal plane formed by the upper surface of the proximal section of the base plate. This arcuate motion is also, as mentioned above, along a plane perpendicular to the longitudinal axis of the central axle. Arcuate movement of the restrictor bar (transfer bar) occurs when torsional force—a lateral biasing force causing internal and external rotation of the actuator arm—is applied to the transfer arm via a user's application of such force to the hand grip of the actuator arm. (As mentioned above and below, the proximal end of the actuator arm rigidly affixed to the restrictor arm so that the longitudinal axis of both bars are in alignment.)

In preferred embodiments of the present invention, the proximal terminus of the restrictor arm is continuous with and terminates in a restriction finger. In such embodiments of the present invention, the restrictor arm is so named due to the ROM (Range of Motion) functions discussed immediately below. The restriction finger is a proximal extension of the restrictor arm especially shaped and configured to engage, along the arm's arcuate path, restrictor pins which limit the arc through which the restrictor arm, and thus actuator arm to which it is affixed, may travel.

More specifically, in certain preferred embodiments of the present invention, restrictor pin bores are prepared in an arcuate pattern within the upper surface of the proximal section of the base plate corresponding to an arc traversed by the restriction finger during device operation (rotation of the restrictor arm upon the central axle of the hydraulic damper). For example, the restrictor pin bores may be placed along the aforementioned arc at 30 degree intervals with a 0 degree bore being aligned with the restriction finger when the restrictor arm is in a neutral (0 degree position) which corresponds to the position of the device when the longitudinal axis of the restrictor arm is located at the center of the inward and outward arc movements produced thereby. More specifically, the device of the present invention is capable of rotating outward and inward so as to provide corresponding external and internal rotation of the shoulder. At a neutral or "0" position, the device is aligned at the intersection of outward and inward movements and is also aligned with the longitudinal axis of the two section base plate. From this neutral position, the device may be operated so as to perform internal and external rotations of the shoulder by laterally biasing the actuator arm inward and/or outward, as explained in more detail, below. In certain preferred embodiments of the present invention, the degree to which the device may be utilized to move inward or outward from the neutral position can be controlled by placing restriction pins within the restriction bores located, for example, at 30 degree intervals from 0 to 90 degrees inward rotation and 0 to 90 degrees outward rotation. Therefore, the upper surface of the proximal section of the two section base plate will include, from the rearmost portion thereof, a 0 degree bore followed by a 30, 60 and 90 degree bore—on either side of the 0 degree (neutral) position of the restrictor finger. Placement of restrictor pins in such bores is advantageously utilized to control and limit the degree of rotation of the restrictor arm as well as the actuator arm to which it is attached and which is engaged by a user during device operation. Thus, for example, the device may be set to allow inward (or internal) rotation of 60 degrees while limiting outer (or external) rotation to 30 degrees. Although the foregoing example utilizes 30 degree increments and 90 degree endpoints, the present invention is not limited to such increments and contemplates the placement of restriction pin bores in any pattern or increment found useful for therapy.

The actuator arm of preferred embodiments of the present invention is advantageously configured as an elongated bar having a proximal terminus, a distal terminus, a longitudinal axis extending therebetween, an upper surface, a lower surface and two side surfaces (a right and left side surface). A hand grip and an elbow cup, described in greater detail below, are adjustably mounted upon and extend upward from the upper surface of the actuator arm.

The actuator arm, at an area adjacent to the proximal terminus thereof, is affixed to the restrictor arm at a position adjacent to restrictor arm's distal terminus. Therefore, the fixation of the actuator arm to the restrictor arm results in transmission of torsional force from the actuator arm to the restrictor arm. More specifically, torsional force applied to the actuator arm via the handgrip causes the actuator arm and restrictor arm to which it is affixed to move in an arcuate path about the longitudinal axis formed by the central axle of the hydraulic damper. (In operating the device, as described in more detail, below, a user utilizes the hand grip of the device to apply inward or outward lateral force to the actuating arm while the associated elbow is stabilized within the elbow cup.)

As mentioned above, in regard to the rehabilitation and exercise device disclosed in the '199 application, the restrictor arm is affixed to the actuator arm in such a manner and by such means as to create a pivoting attachment therebetween. More specifically, it is preferred that the actuator arm is pivotally affixed to the restrictor arm so that the elevation of the actuator arm may be adjusted from a neutral position, parallel to the planar surfaces of the base plate, to a desired elevated position of, for example, from 0 to 45 degrees. However, as discussed in much greater detail, below, such an arrangement, wherein the actuator arm can be elevated from a horizontal position to a position up to about 45 degrees above the plane formed by the upper and lower surfaces of the mounting plates, necessarily effects the moment arm formed between the diametric center of the central axle and that point, distal along the actuator arm, where the hand grip is positioned. Simply put, elevation of the actuator arm—so as, for example to better accommodate the relation of the upper and lower arm to a user—will necessarily decrease the distance from the point of torsional application (hand grip) to a point along the longitudinal axis of rotation—and thus increase the amount of force required to effect inward/outward arcuate movement of the actuator arm.

In contrast to the foregoing, the exercise and rehabilitation device of the present invention utilizes a configuration in which the distal portion of the restrictor arm and proximal portion of the actuator arm are affixed—in a set position—without utilization of a pivoting joint. Simply put, the actuator arm of the present invention is rigidly affixed to the restrictor arm so that both arms lie and remain along the same longitudinal axis which is rigidly held in such relationship. For this purpose, the device of the present invention may advantageously utilize side plate as a means of affixing the actuator arm to the restrictor arm. The side plates may be configured, for example, as flat elongated plates having two broad planar surfaces, an upper edge, a lower edge, a proximal terminus and a distal terminus. The side plates advantageously include a plurality of threaded bores penetrating through the two broad planar side surfaces. In the preferred embodiment of the present invention, the right and left sides of the actuator bar include a space formed therebetween which is especially shaped and configured so that a portion of the proximal end of the actuator bar may be received between the right and left sides of the restrictor arm. In addition, the right and left sides of the restrictor bar lying lateral to the space therebetween include bores therebetween which are so spaced and formed so as to enable alignment thereof with the threaded bores of the two side plates. Thus, placement of the side plates, within the channels formed in the left and right sides of the actuator bar—near the proximal terminus thereof—enables affixation of the actuator bar to the restrictor bar as follows. After the side plates are plates in the right and left channels of the actuator bar, the actuator bar is fitted within the space formed between the right and left side walls of the restrictor bar. It is so placed so that the bores formed in the side plates align with those formed in the sides of the restrictor bar. By placing assembly bolts through the bores through the bores formed in the restrictor are and thereafter engaging the threaded bores formed in the side plates lying in the channels formed in the sides of the actuator bar, tightening said bolts rigidly affixes the actuator bar to the restrictor bar.

In an alternate preferred embodiment of the present invention, the restrictor arm and the transfer arm are formed as one continuous structure referred to herein as an operation arm (or operator arm). In such embodiments, the operation arm includes a restrictor section at the proximal portion thereof and an actuator section distal thereto located at the distal portion of the operation arm. The restrictor and actuator sections are arranged and configured substantially the same as the restrictor arm and actuator arm in the first preferred embodiments wherein such elements are physically separate and formed individually. Thus the restrictor section is configured and adapted so as to provide the same functions as the restrictor arm and the actuator section is configured and adapted to provide the same functions as the actuator arm in the first preferred embodiment. However, the device of the alternate preferred embodiments utilizing and operation arm forms both said actuator section and restrictor section out of one continuous structure. Thus, such embodiments do not require a means of affixing such sections to one another.

The rehabilitation and exercise device of the present invention utilizes an improved means of adjusting the device to conform to various user's and supporting surface dimensions and desired angular relations between the upper and lower arm while such users operate the present device. The device of the present invention is especially designed and configured to utilize a two section base plate which such sections are affixed via an articulating joint. The articulating joint of the base plate, as described in much more detail below, enables a user to change the elevation of the actuator arm, relative to the top surface of the structure to which the device is mounted —without altering the angular relationship between the plane along with the arcuate path of operation lies in relation to the longitudinal axis of the central axle upon which the actuator arm rotates. Simply put, by allowing the proximal portion of the proximal section of the base plate to lower, the elevation of the actuator arm rises relative to the surface upon which the distal section of the base plate is affixed. However, since the actuator arm and central axle of the damper move in unison, no change in angular relation occurs. Thus, increasing elevation of the actuator arm in the present invention does not alter the amount of torque necessary to operate the actuator arm at any given speed. The plane of arcuate motion of the actuator arm always lies in the same relationship (substantially perpendicular) to the longitudinal axis of rotation.

The elbow cup of the present invention is especially configured and adapted for comfortable and secure placement of a user's elbow therewithin. Likewise, the handgrip is adapted and configured for secure grasping by a user's hand. The handgrip is affixed and positioned along said actuator arm distal to the position of the elbow cup. The device of the present utilize adjustable mounting for both the elbow cup and hand grip. Thus, in regard to the preferred embodiment of the present invention, the upper surface of the actuator arm may be configured (as described below) to include an adjustment channel along which both the hand grip and elbow cup may be moved. Any adjustable fastener such as, for example, a nut and bolt (with washer) may be utilized to affix the hand grip and elbow cup at a desired position within the channel. Ordinarily, the elbow cup is positioned so that an elbow placed therein is positioned to be as close as possible to overly the axis of arcuate motion (and the central axle that forms this axis). Although, in most instances, the elbow cup will remain close to the rotational axis, special circumstances including, but not limited to special therapeutic needs and unusual physical dimensions may require some adjustment of the position of the elbow cup. Due to varying user physical dimensions, the distance between the user's elbow and hand is accurately accommodated by adjusting the position of the handgrip. However, in addition to the aforementioned adjustments disclosed in regard to the device disclosed in the '191 application, the exercise and rehabilitation device of the present invention utilizes a two piece articulating base plate. The articulating base plate, as described in more detail, below, enables affixation of the device of the present invention to table tops and other support structures of various heights as well as use thereof by individuals with varying sized upper and lower arms, without having to change the angular relationship between the arcuate motion of the actuator arm and the longitudinal axis of rotation of the central axle. Such adjustability also enables one to locate the elbow cup in a position more closely aligned with the longitudinal axis of the central axle of the hydraulic damper.

When utilizing the shoulder therapeutic and exercise device disclosed in the present invention, the device must first be stabilized against movement by means of the distal section of the base plate. For this purpose, embodiments of the present invention utilizing the screw clamp fixation means discussed above and below, for example, may affix the distal section of the base plate, to a table top. Once the device is so stabilized, a user positions the elbow corresponding to the shoulder to be exercised within the elbow cup. As discussed above, the elbow cup is ordinarily located so as to place the user's elbow to lie as close as possible above the central axle (and thus at the axis of rotation). In certain instances, and depending upon therapeutic needs of the individual, some proximal distal/adjustment of the elbow cup may be required. For example, if the height of the surface to which the device is mounted, or the height of the chair a user is such that there is insufficient distance between the user's shoulder and the elbow cup to enable the user's shoulder to be directly over the user's elbow, the elbow cup may be moved distally in order to obtain a more favorable relationship between shoulder and elbow. However, the device of the present invention, which incorporates a two piece articulating base plate, enables one to adjust the angle between the surface upon which the device is mounted and the plane across which arcuate motion of the actuator bar is performed. This additional adjustment feature enables, in certain instances, one to maintain the position of the elbow cup (as well as the elbow therewithin) in a position closer to overlying the longitudinal axis of the central axle despite a less than favorable mounting surface height, chair height, user's physical dimensions. However, the exercise and rehabilitation device of the present invention enables adjustment in regard to elbow cup and hand grip position, if desired, in substantially the same way as disclosed in the '191 application. In regard to both devices, once the position of the elbow cup is fixed, the hand grip position is adjusted so that, while the users elbow is comfortably situated within the elbow cup, his hand may easily grip the hand grip while the forearm overlies the longitudinal axis of the actuator arm so as to achieve a proper hand grip position. Once the proper hand grip position is achieved, embodiments of the present invention including a restrictor arm (with restrictor finger, restrictor bores and restrictor pins) may be adjusted to provide a desired ROM (range of motion) for internal and external rotation of the shoulder. Restrictor pins provide a positive stop which physically prevents a user from surpassing the set ROM. As described above, for this purpose, restrictor pins are placed in restrictor bores corresponding to the desired maximum degree of external and internal rotation. Placement of the restrictor pins within the restrictor bores located along the arcuate path of the restriction finger therefore prevents a user from exceeding the ROM limits defined and set thereby.

The exercise and rehabilitation device of the present invention utilizes a two section base plate comprised of a proximal and distal section. The proximal and distal sections each include an upper and lower planar surface, a proximal end and distal end, a right and left side. In preferred embodiments of the present invention, the proximal section of the base plate is pivotally joined to the distal section by means of a hinge joint located at the distal end of the proximal section and proximal end of the distal section. The hinge joint may be advantageously formed, for example, utilizing a barrel hinge configuration. More specifically, and in regard to a first preferred embodiment of the present invention, the proximal section of the base is especially designed and configured to include two lateral pin receiving barrels (a right and left lateral pin receiving barrel) especially positioned and formed for secure receipt and engagement of a hinge pin. The lateral pin receiving barrels are positioned at the distal end of the proximal section adjacent to the right and left sides of the proximal plate. There is sufficient space between the left and right pin receiving barrels so that, upon alignment of the distal end of the proximal section with the proximal end of the distal section, sufficient space is provided between the right and left receiving barrels for positioning of the central pin receiving barrel described below.

The two lateral pin receiving barrels are, in fact, hollow cylinders having a central bore running the full length of each such receiving barrel, the diameter of said bores being selected in order to enable a hinge pin to pass through the central bore of both lateral receiving barrels. The distal segment of the base plate is formed to include a central pin receiving barrel located at the proximal end thereof and substantially centered between the left and right sides thereof. The central pin receiving barrel also demonstrating a central bore therewithin of equal dimension to that of the central bores of the lateral hinge receiving barrels. The distal section of the base plate of the present invention also advantageously includes a means for affixing the device to a surface such as, for example, a table top. In a preferred embodiment of the present invention, the distal section of the two piece base plate includes two screw clamps, substantially the same as those disclosed in the '191 application, in order to enable fixation of the device to a flat surface (such as a table top. The proximal section of the base plate is not fixed—directly—to a supporting surface, but rather is pivotally affixed to the distal section.

The two lateral pin receiving barrels formed at the right and left distal portions of the proximal section of the base plate and the central pin receiving barrel of the distal section of the plate are designed, configured and positioned so that when the two sections of the base plate are aligned, one another upon a planar surface, the central bores of all three pin receiving barrels can be aligned so as to enable receipt of a hinge pin. The hinge pin, in turn, is selected to demonstrate a diameter that enables the pin to pass through each of the central bores of the receiving barrels while providing enough engagement therewith so as to resist loss of the pin from said receiving barrels. The length of the hinge pin is selected so that the pin will effectively pass through and remain within the full length of all of the receiving barrels so as to provide a pivot axis.

In addition to the incorporation of a barrel hinge joint enabling the two section base plate to pivot, the base plate of certain preferred embodiments of the present invention advantageously includes an elevation control and locking means. The elevation control and locking means, in actuality, enables the proximal section of the two piece base plate to be lowered, relative to the distal section to a desired point—so as to provide desired elevational angles of the restrictor arm and transfer arm (to which it is affixed) relative to the distal section of the base plate and the surface to which the device is mounted. In regard to preferred embodiments of the present invention, the elevation control and locking means comprises at least one elevation control plate, two elevation pin mounting plates, and an elevation pin.

In regard to the first preferred embodiment of the present invention, the proximal section of the base plate is designed and configured to include two elevation control plates affixed to the right and left lower side thereof in close proximity to the distal end of the proximal plate. The distal section of the two section base plate, in turn, includes two elevation pin receiving plates affixed to the right and left sides of the distal section of the base plate proximal to the proximal end thereof. Each of the elevation control plates includes, in a arcuate pattern, an elevation adjustment groove wherein an arcuate groove is formed including a series of elevation lock bores at selected positions along the groove. The arcuate groove and elevation lock bores formed therein are especially configured, positioned and formed so that when the distal section of the base plate is mounted upon a surface, the pivoting articulation provided by the above-described barrel hinge joint will coincide with movement of the below described elevation pin within the arcuate path defined by the elevation adjustment groove.

As discussed above, the elevation control and locking means of the preferred embodiments of the present invention include an elevation pin. The elevation pin is comprised of an elongated rod having at least one barrel like enlarged portion—an elevation bore lock—located thereupon where the diameter of the pin is substantially equal to that of the elevation lock bores formed along the elevation groove. In regard to the first preferred embodiment of the present invention, the elevation pin includes two such elevation bore locks. At one end of the elevation pin, the pin demonstrates a greater diameter so as to form a control button. One of the elevation pin receiving plates includes, in axial alignment with an elevation pin receiving bore formed therein, a pin receiving cap. Within the cap, an elevation pin control spring is housed which acts so as to bias the elevation pin inward, in the direction of the opposite pin receiving plate. The elevation pin also passes through the elevation pin mounting plate located at the opposite side of the proximal plate. A bushing is provided on the lateral surface of this mounting plate so as to allow control button to extend lateral to the bushing while, at the same time, allowing the control button (and the elevation control pin) to slide laterally. For example, in the first preferred embodiment of the present invention, the control button formed at one end of the elevation pin is affixed to one of the elevation pin receiving plates by means of a bushing. The bushing is formed to include a central bore through which the button may pass laterally—by action of the elevation spring—until reaching a terminal lateral position. At this position, a ring like rib formed circumferentially near the medial terminus of the button engages a circumferential crimped portion located in the bore of the bushing adjacent the lateral end thereof. Since the bushing is affixed to the elevation pin mounting plate the lateral crimp of the bushing acts retain the pin in place when lateral displacement of the pin, provided by the elevation pin spring causes the pin to reach a maximum lateral position. Thus, this configuration acts to contain the elevation pin within the elevation pin mounting plates and loss from the device.

The elevation pin is configured and formed so that when the pin is displaced to its maximum lateral position (by action of the elevation spring) the enlarged barrel like portions of the pin—the elevation pin bore locks—align with the bores formed in the elevation slots. When the button is depressed inwards (medially) the barrels move out of the bores so that the elevation pin may allow the base plate to articulate (the elevation pin now being able to pass along the arcuate path of the elevation slot.) Simply put, the reduced diameter of the elevation pin adjacent to the elevation bore locks enables full articulation of the hinge joint formed between the proximal and distal sections of the base plate. Release of the elevation pin button when the barrels are aligned with an elevation bore formed in the elevation groove locks the relationship (the elevation) in a set position.

In order to take full advantage of the two piece base plate and the elevation means provided by the aforementioned barrel hinge and elevations adjusting means, the damper is mounted to the lower surface of the proximal portion of the base plate so that the longitudinal axis of the central axle and the rotational bath thereof is perpendicular to the planar top and bottom surfaces of the two piece base plate. Accordingly, the restrictor arm which is mounted upon the central axle and the actuator arm which is rigidly affixed thereto follows an arcuate path parallel to the top and bottom planar surface of the proximal section of the two piece base plate. The present invention utilizes an articulating two section base plate in order to provide adjustment in elevation to the actuator arm relative to the surface upon which the distal section of the base plate is mounted.

Thus, in utilizing the exercise and rehabilitation device of the present invention, a user may alter the elevation of the actuator arm relative to a supporting surface. However, in utilizing the device of the present invention, increases in actuator arm elevation are accomplished as follows in regard to the first preferred embodiment thereof. Initially, the device is affixed to a surface such as, for example, a table top. Such affixation is accomplished by affixing the distal section of the two section base plate to such a table top by, for example, the use of two screw clamps. Thereafter, by depressing the elevation pin control button located lateral to one of the elevation pin receiving plates, the pin slides medially (inwardly), biasing against the elevation pin spring located in cap attached laterally to the opposite elevation pin receiving plate. Such movement of the pin displaces the elevation bore locks out from within the elevation lock bores thereby allowing the pin to freely move through the arcuate path of the elevation grooves. By pivoting the proximal section of the base plate downward in relation to the mounted distal section thereof, a user may select a desired elevation. By releasing the button end of the elevation pin, the elevation spring moves the pin laterally, towards the button end thereof so as to cause the elevation bore locks to engage the elevation lock bores located along the elevation grooves. Once released in this position, the elevation spring holds the bore locks within the elevation lock bores thereby locking the angular relationship between the proximal and distal sections of the baseplate and providing a specific elevation of the actuator arm. As discussed above, a bushing crimp and ring formed in the elevation spring button prevent further lateral displacement of the elevation pin from the elevation pin mounting plates. Of course it is the barrel hinge, also discussed above, that provides that aforementioned articulation between the proximal and distal sections of the base plate while the elevation pin, bores, springs and mounting plates lock in the desired elevation.

After device of the present invention has been adjusted as described above, the user may then inwardly and outwardly rotate the actuator arm by applying a corresponding inward and outward lateral force thereto via the handgrip. A user may increase the resistance (and thus exercise difficulty) provided by the device to such motion by simply increasing the force he or she applies to the actuator arm via the hand grip. The increased force tends to cause the arcuate motion of the actuator and restrictor arm to accelerate. This acceleration in movement is transferred to the hydraulic damper via the central axis. More specifically, increased speed of rotation of the central damper necessarily causes an increase in rotation of the central axle which, in turn, cause an increase in the velocity of hydraulic fluid propelled by a fluid propulsion means such as, for example, piston(s), vane(s) or fin(s). This increased speed forces an increased volume of fluid through the apertures of a hydraulic fluid flow valve (also referred to herein as hydraulic flow valve and flow valve) The effect of the forcing of the increased volume of fluid through the aperture is, of course, increased resistance to flow and, accordingly, the hydraulic piston(s), vane(s) or fin(s) provide more resistance to the rotation of the central axle which, in turn, is transmits such increased resistance to the restrictor and actuator arm.

In certain preferred embodiments of the present invention, the hydraulic damper includes a resistance adjustment wheel which controls an adjustable hydraulic flow valve. A user may turn the adjustment wheel to a selected position indicated by, for example, a number on the wheel which is aligned with a mark adjacent the damper. Movement of the wheel varies the aperture of an adjustable hydraulic fluid flow valve. More specifically, turning the wheel in one direction has the effect of increasing the aperture of the valve. An increase in flow valve aperture causes, as is well known to the art of hydraulic fluid dynamics, a reduction in resistance to flow. This reduction in flow resistance, in turn, results in a decrease resistance of the hydraulic damper to rotation via inward and outward rotation of the actuator arm. Conversely, turning the resistance adjustment wheel in the other direction has the effect of decreasing the aperture of the hydraulic fluid flow valve, which increases the resistance presented by the valve to hydraulic fluid flow. Such increased valve resistance, in turn, increases the resistance to movement of the damper piston(s), vane(s) or fin(s) and thus increased resistance presented by the damper to the restrictor and actuator arm via the central axle. Thus, rotation of the resistance adjustment wheel in one direction increases resistance to user inward and outward rotation of the actuator arm while rotation of the resistance adjustment wheel in the opposite direction decreases such resistance. However, regardless of the adjustment wheel setting, increased lateral force applied to the hand grip of the device by a user attempting to perform internal and/or external shoulder rotations will, of course, increase resistance to such movement generated by the hydraulic damper due to well known principles of hydraulic dynamics. Conversely, a user's reduction in force applied to the hand grip will result in a decrease in hydraulic damper resistance to movement.

The device of the present invention is designed and configured to enable a user to utilize the device by placing the forearm corresponding to the shoulder to be exercised upon an actuating arm while the elbow of that same arm is retained in an elbow cup and the associated hand grasps an upright handgrip (described in more detail, below). The device of the present invention allows a user to perform both internal and external rotations of the shoulder joint by rotating the actuating arm in an arcuate pattern which causes a corresponding rotation of the related shoulder. Internal and external rotations of both the right and left shoulders are performed without need to make any adjustment to the device as the arcuate path provided thereby encompasses both motions.

The shoulder rehabilitation and exercise device of the present invention provides resistance against the aforementioned internal and external rotations which is proportionally and automatically increased and decreased in reaction to increasing and decreasing torsional force (respectively) applied to the device by a user. Thus, a user can increase resistance to shoulder rotations by simply applying greater torque to the actuating arm, and thus moving the device with greater speed without the need to make manual weight and/or other resistance adjustments.

All embodiments of the present invention are especially designed, configured and formed to be highly portable exercise/rehabilitation devices. The term "highly portable exercise/rehabilitation device" as utilized throughout this specification and within the claims refers to a device which, due to relatively light weight and ability to be quickly, easily and reversibly affixed to a surface for use, can be easily moved from place to place by one person, with very little effort. In order to achieve such portability, it is preferred that the device of the present invention weigh from about 5 to about 20 pounds and include a quick and simple means for releaseably affixing the device to a surface for use (which such means are described, in detail, both above and below). However, it is preferred that the device of the present invention weigh from about 7 ½ pounds to about 15 pounds. It is still further preferred that the device weigh between 8 and 12 pounds. The aforementioned weights and means of reversible affixation enable to the device to be easily transported from place to place as well as enabling such devices to be easily moved from storage to a point of use without requiring great effort, complicated tools, or additional personnel necessary to transport therapeutic devices of greater weight and requiring permanent mounting. The term "reversible affixation" as utilized within the specification and throughout the claims refers to a means which enables the device of the present invention to be stabilized to a surface, and then, if desired, quickly and easily removed therefrom for transportation. For example, the clamp means described above, and below, including the integral clamps and separate external clamps, comprise means of reversible affixation.

The rehabilitation and exercise device of the present invention protects a user from deleterious effects of rehabilitation and/or exercise device inertia and stored (potential) energy. More specifically, when a user stops applying force to the actuating arm of the device, the arcuate movement of the arm terminates—without the device resisting termination of movement via application of inertial, kinetic or stored energy that would otherwise have the effect of opposing such termination of movement—. Simply put, upon termination of the application of force by a user, the device of the present invention ceases the above-described arc-like movement so as to protect a user from the action of inertial or the release of stored potential energy that might otherwise cause injury.

DETAILED DESCRIPTION OF THE PREFERRED EMBODIMENT

Figure 1:
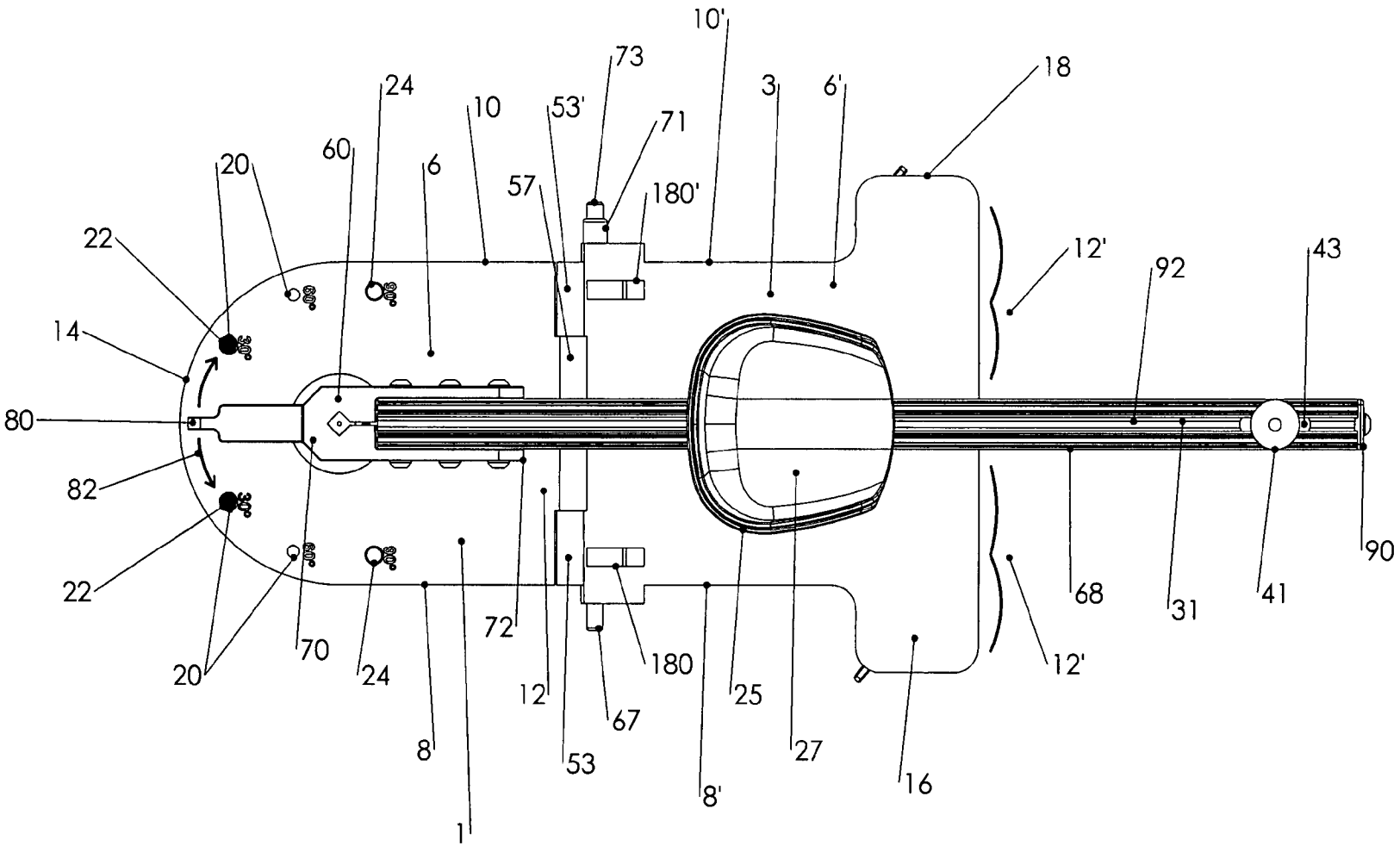
FIG. 1 illustrates a top view of a preferred embodiment of the present invention.
Figure 2:
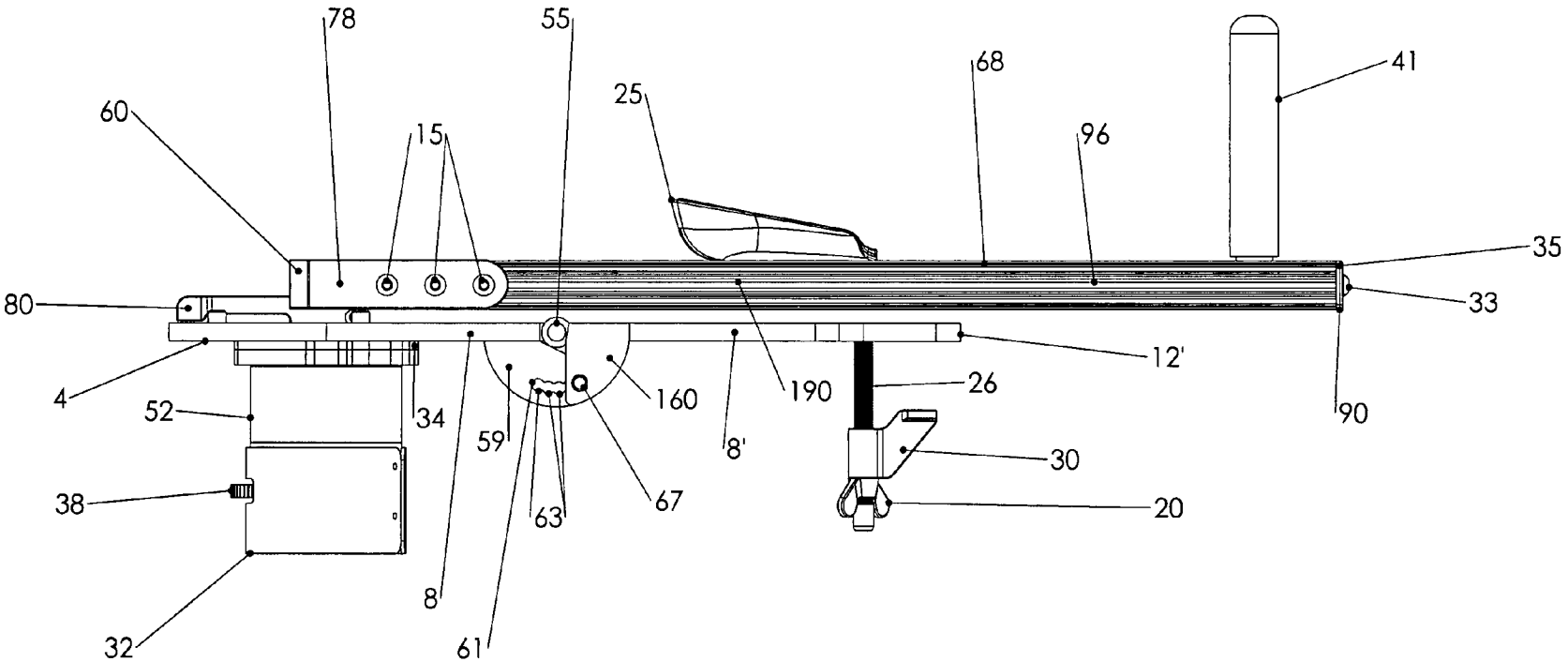
FIG. 2 is a side view of the preferred embodiment illustrated in FIG. 1.
Figure 3:
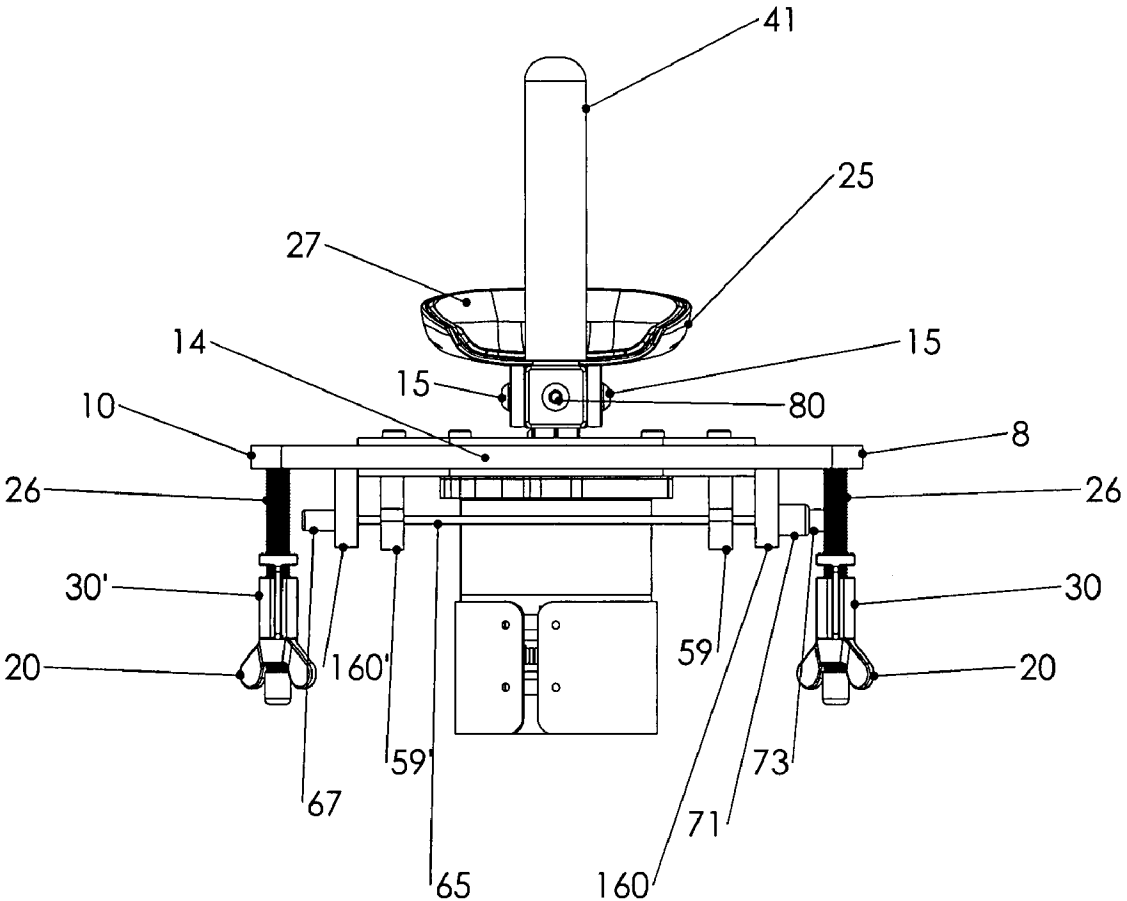
FIG. 3 is a rear view of the preferred embodiment illustrated in FIG. 1.
Figure 4:
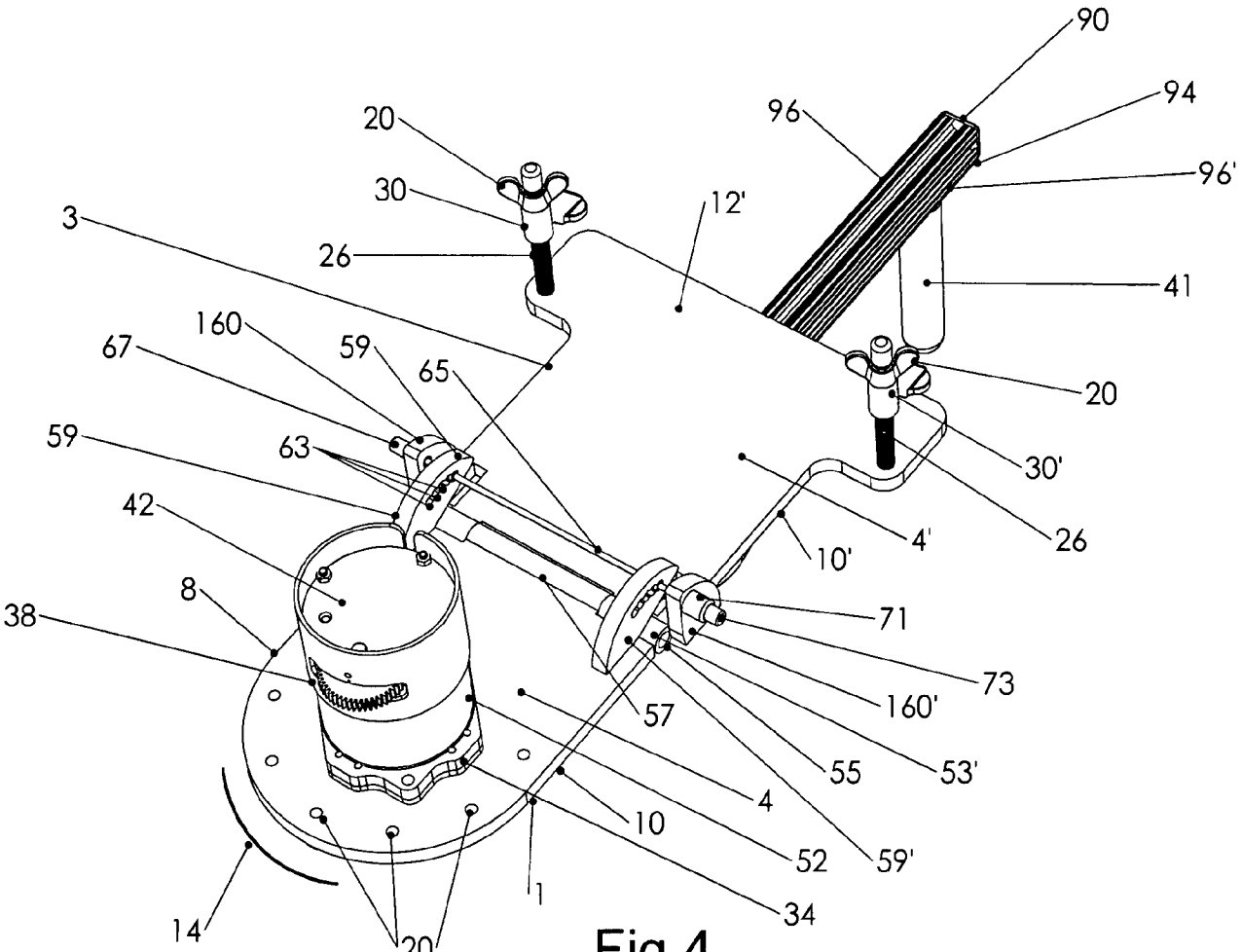
FIG. 4 is a bottom isometric view, from a left aspect, of the preferred embodiment illustrated in FIG. 1.
Figure 5:
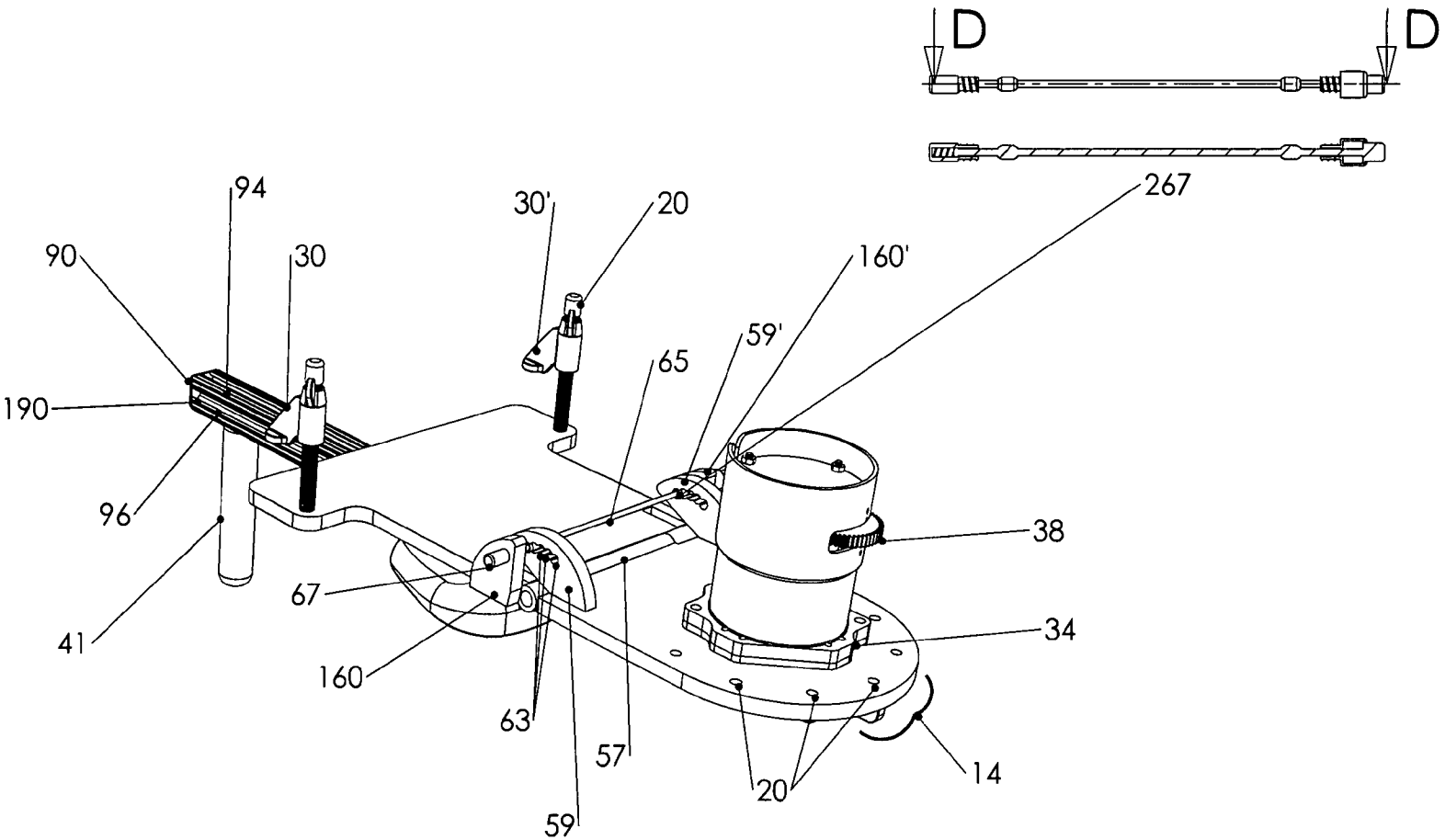
FIG. 5 is an additional bottom, isometric view, from a right aspect, of the preferred embodiment illustrated in FIG. 1.
Figure 6:
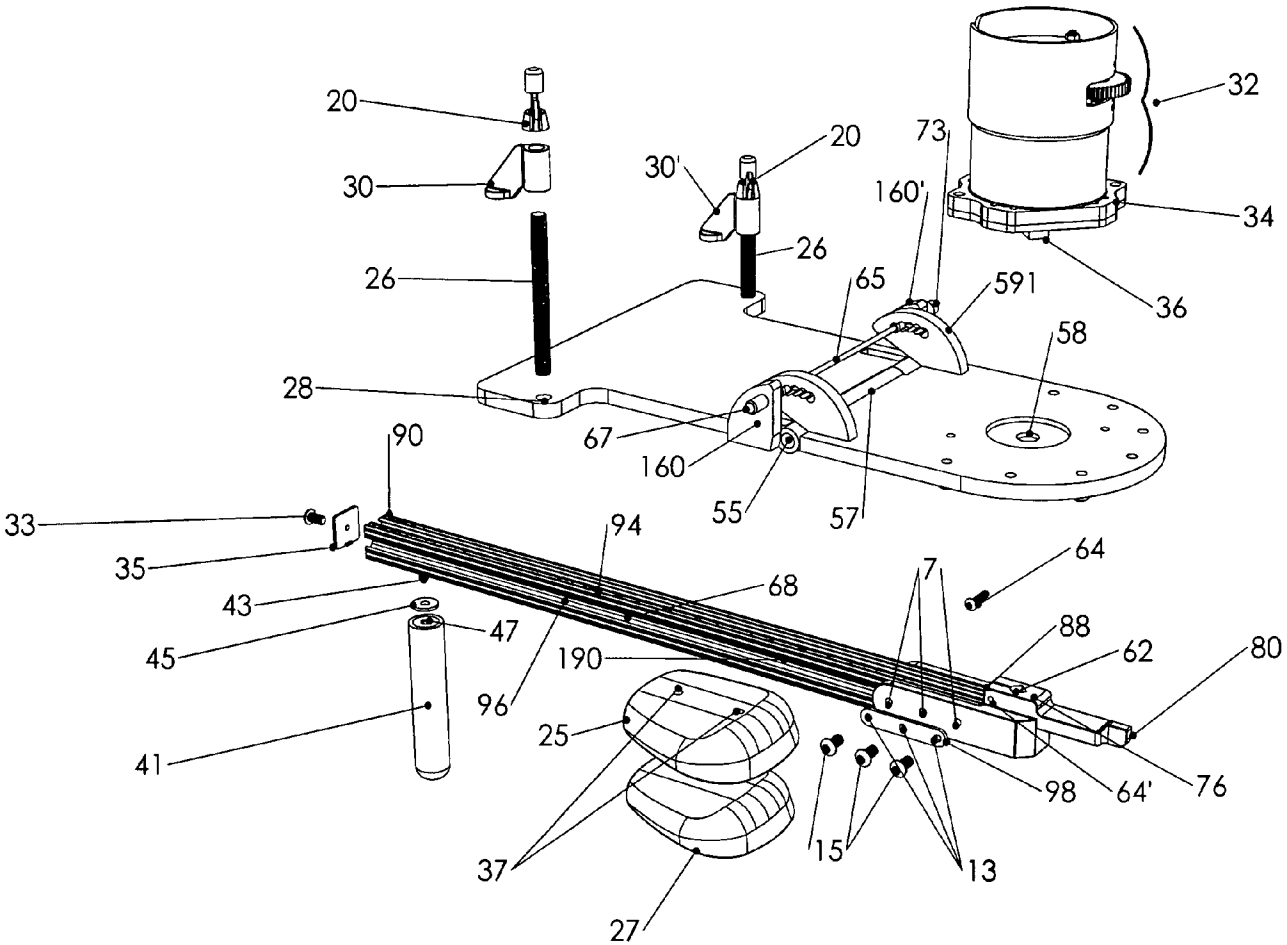
FIG. 6 is a bottom isometric exploded view of the device of the present invention illustrated in FIG. 1.
Figure 7:
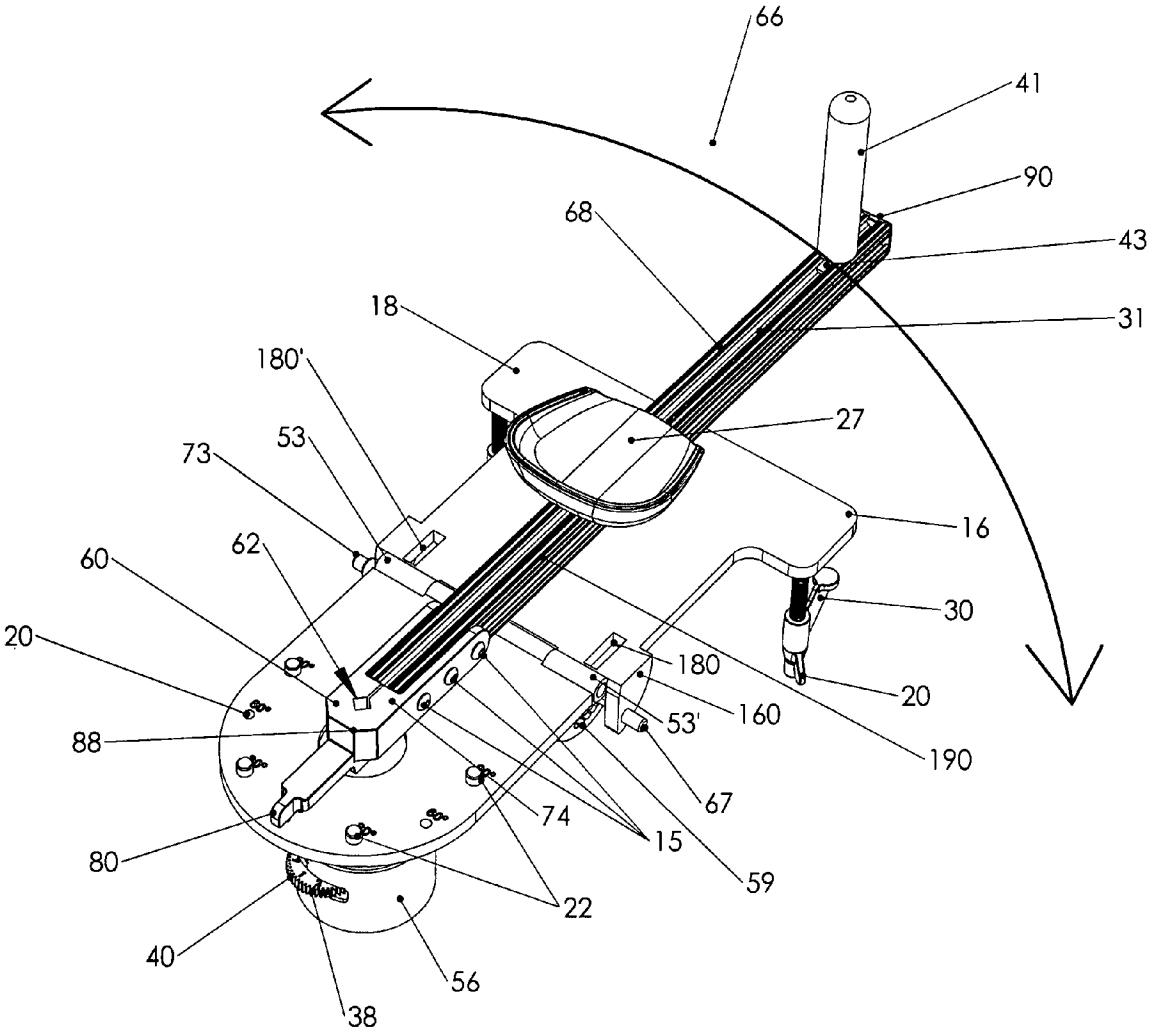
FIG. 7 is top isometric view of the device of the present invention illustrated in FIG. 1.
Figure 8:
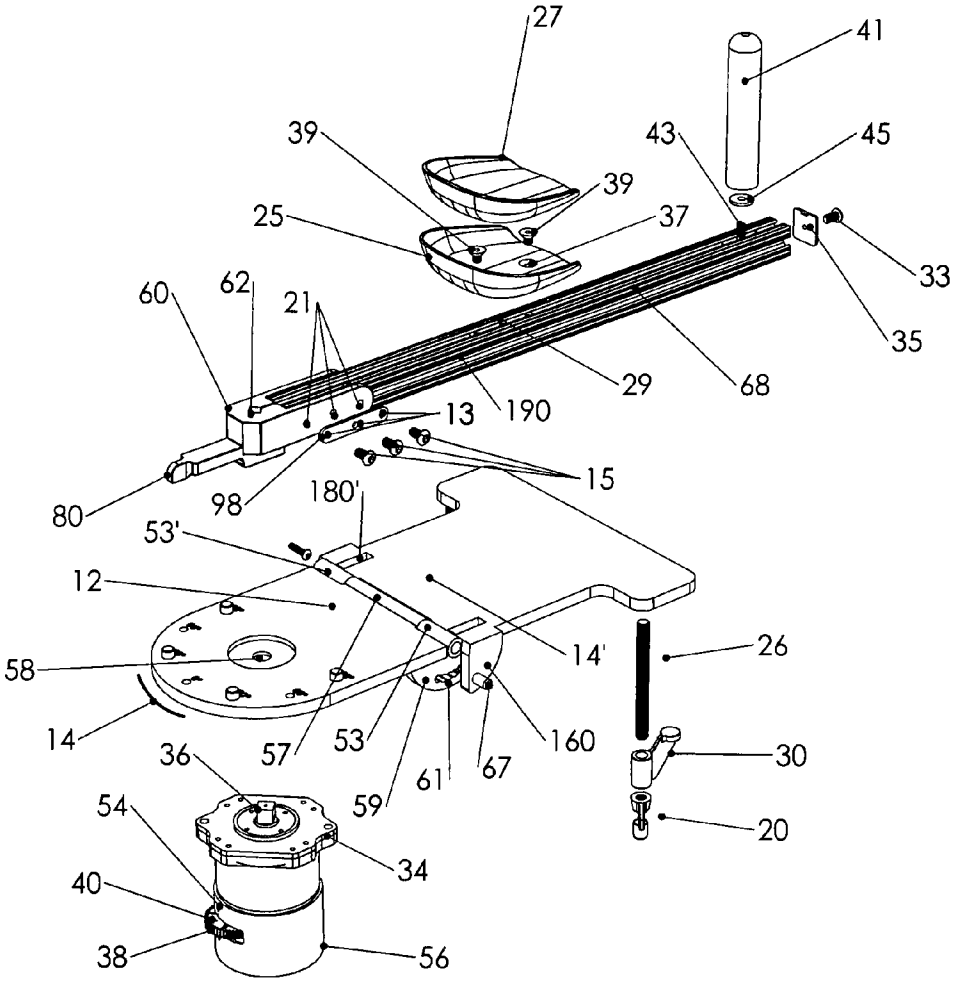
FIG. 8 is a top isometric exploded view of the device of the present invention illustrated in FIG. 1.
Figure 9:
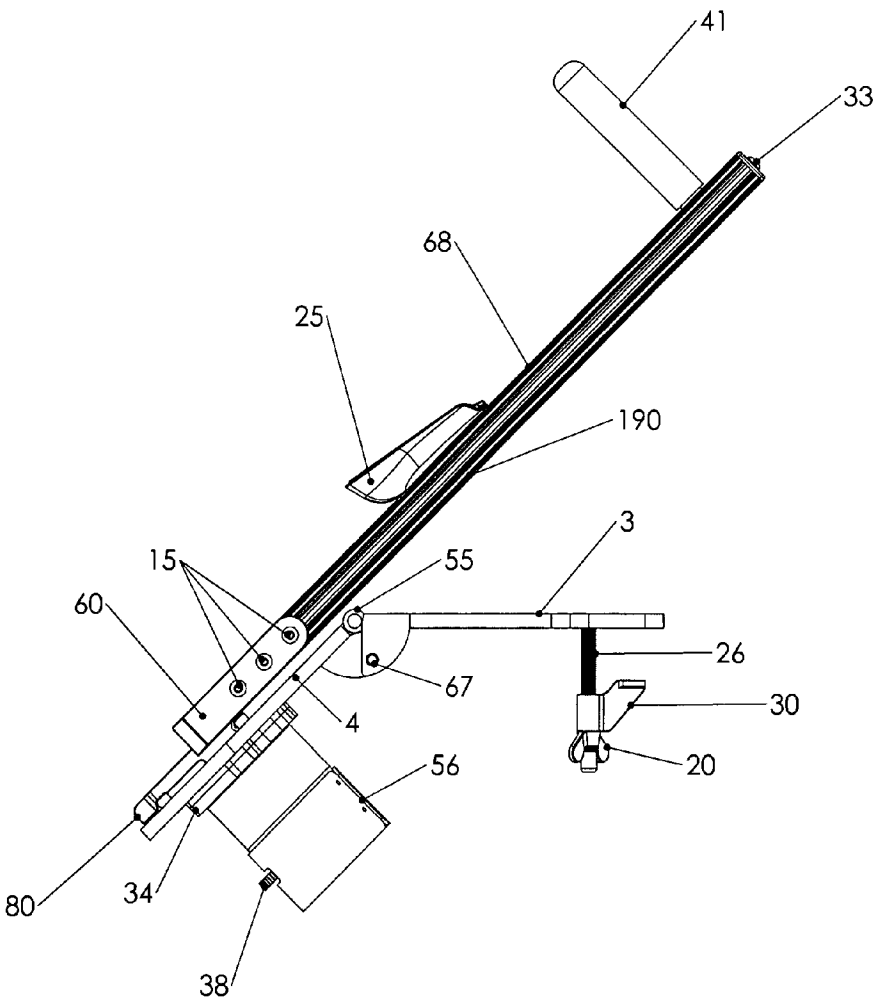
FIG. 9 is a side view of the device illustrated in FIG. 1 in an articulated position.
Figure 10:
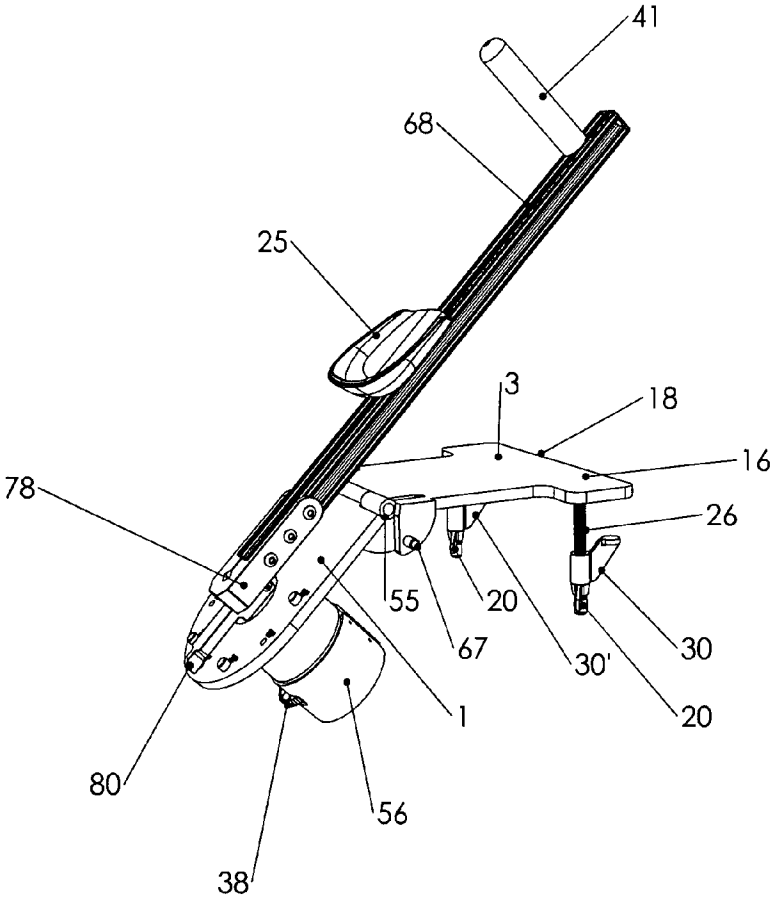
FIG. 10 is an isometric side view of the device illustrated in FIG. 9. In an articulated position.
Figure 11:
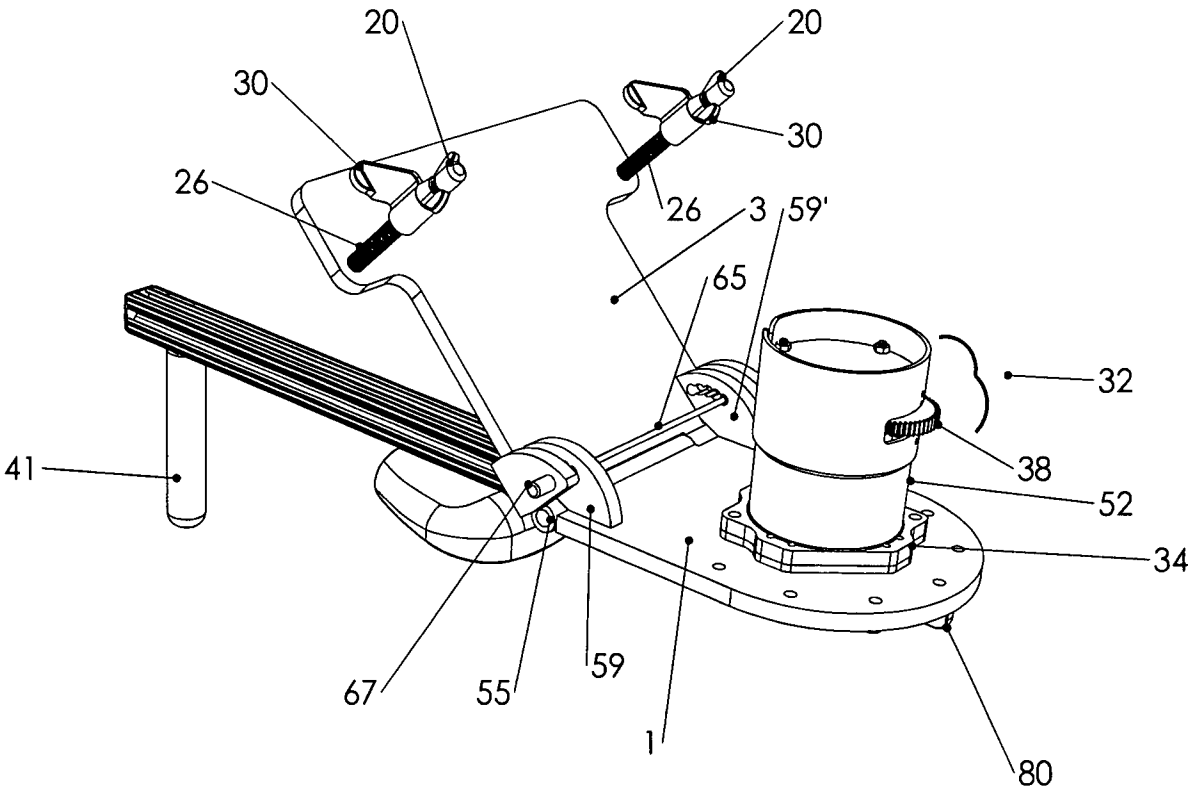
FIG. 11 is a isometric bottom view of the device illustrated in FIG. 1 in an articulated position.
Figure 12:
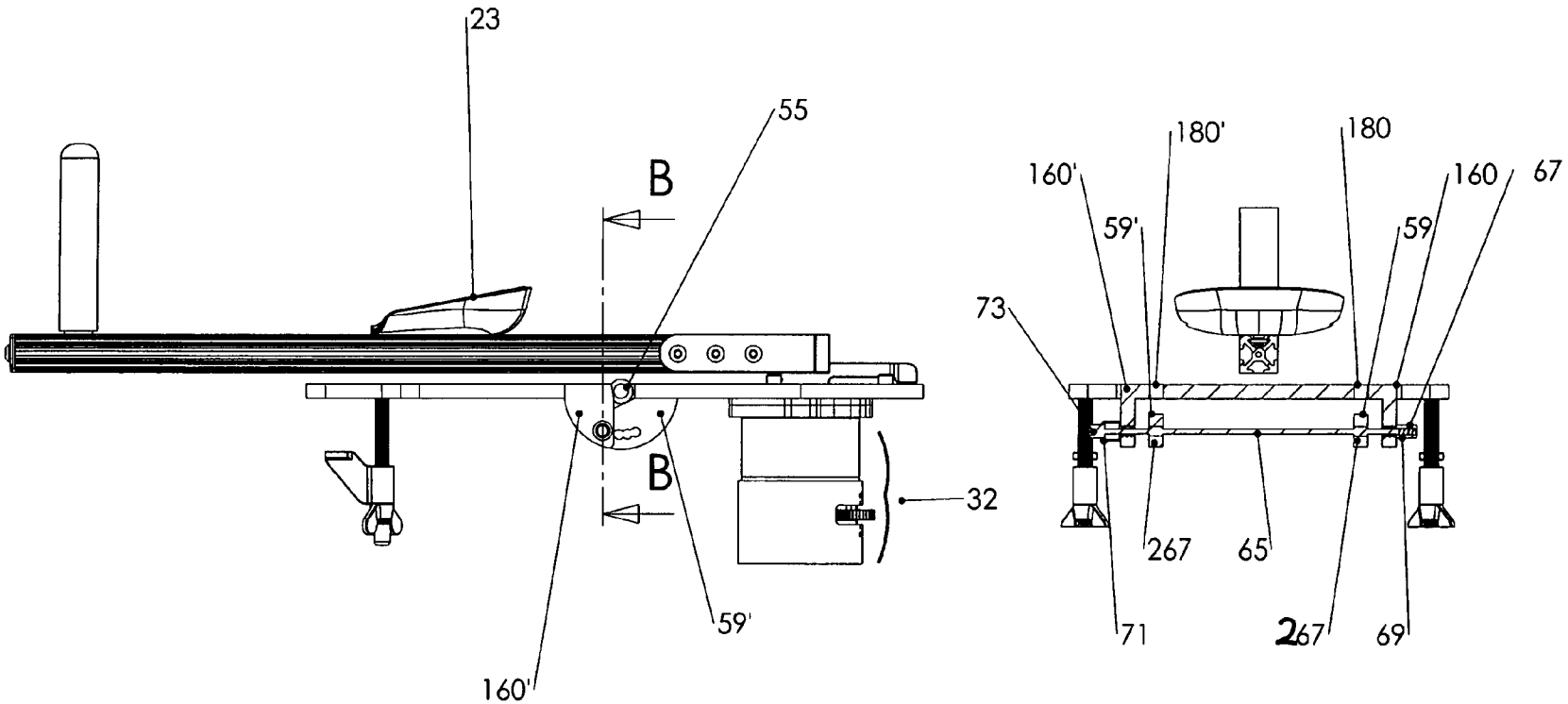
FIG. 12 is a sectional rear view of the device illustrated in FIG. 1
Figure 13:
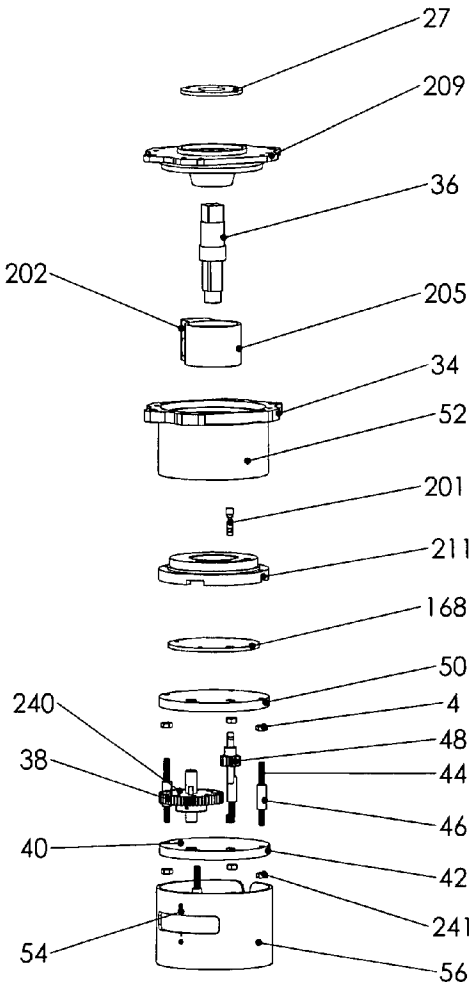
FIG. 13 is an exploded view of a hydraulic damper utilized in the preferred embodiment of the present invention illustrated in the figures.

The drawing FIGS. (1-13) illustrate a preferred embodiment of the shoulder therapeutic and exercise device of the present invention which incorporates an articulating two section base plate. As illustrated in the figures, the base plate is configured as separate proximal 1 and distal 3 sections. The proximal base plate section has a lower planar surface 4, an upper planar surface 6, a right edge 8 a left edge 10 a distal portion 12 and a proximal portion 14. Likewise, the distal base plate section has a lower surface 4', an upper surface 6', a right edge 8' a left edge 10' a distal portion 12' and a proximal portion 14'. The two section base plate may also be described as having a longitudinal axis running from the proximal to distal portions of each section of the base plate, along the midline thereof, the longitudinal axis of each base plate aligned with one another when the planar upper and planar lower surfaces of the base plates are also aligned, one with the other along the same horizontal plane (at a zero degree relation). The overall shape of the distal section of the two piece base plate configuration utilized in the preferred embodiment illustrated in the figures includes two distal extensions 16 & 18. As discussed in more detail below, these distal extensions of the distal portion of the base plate of this particular embodiment of the present invention enable the base plate to easily engage either the corner portion or side edges of a table top and also provide greater spacing between screw clamps located at those points when the device is affixed to those or any other surfaces utilizing such fixation devices. The distal section of the base plate also advantageously includes two elevation control plate pass through slots 180 and 180' located near the right and left edges of the proximal terminus of the distal section of the base plate. These pass through slots are especially configured and conformed so as to enable the below described elevation control plates to pass through the distal section of the base plate when the proximal portion of the plate is lowered for elevation adjustment purposes. The proximal section of the base plate illustrated also includes restrictor bores, which, as described above and below are utilized to engage restrictor pins 22 which, in turn, restrict the range of motion of the device. The embodiment illustrated in the figures also includes a restrictor screw which threads into a selected restrictor bore 24—which advantageously includes threads within the baseplate to provide a positive stop which must be unscrewed to be removed and repositioned. In the figures, the restrictor bore is located at the 90 degree position which limits the rotation of the restrictor arm to 90 degree clockwise and 90 degree counterclockwise rotation.

The two section base plate may be formed of any material demonstrating sufficient strength and rigidity so as to withstand the forces generated during use of the device. For example, the base plate may be formed of a metal such as steel, aluminum or alloys thereof. However, the two section base plate may also be formed of high strength plastic materials such as, for example composite plastics such as carbon fiber reinforced plastic and fiberglass materials.

The preferred embodiment illustrated in the figures includes the above-described screw clamp located in the distal section of the base plate as a means for affixing the device to a table top. More specifically, threaded anchor studs 26 engage and are affixed in anchor stud bores 28. Clamps 30, and 30' are slideably mounted upon each of the aforementioned threaded studs. Each of the studs is also fitted with a wingnut 20. The base plate of the preferred embodiment is shaped and configured so that the distal portion of the distal base plate, includes distal extensions 16 and 18. In configuring the device in this manner, the clamps 30 and 30' mounted upon the studs extending downward from distal extensions of the base plate, provide greater stability for the device. Such a configuration also enables the device to be oriented so as to engage the underside of a table top, lateral to and on either side of the corner. At the same time, these clamps may also be utilized to affix the distal section of the base plate to a table top along the side of the structure. By tightening each of the wing nuts, the clamps move towards the undersurface of the table top and thereafter engage same while the bottom surface of the base plate is biased against the top surface of the table. However, such clamps may also be utilized to attach the device to any other stable surface available for device placement.

A rotary hydraulic damper 32 is mounted upon the lower planar surface of the proximal section of the base plate via damper mounting plate 34 and associated bolts. The hydraulic damper is mounted and positioned upon the proximal base plate so that the central axle 36 thereof extends through the upper surface of the base plate along the longitudinal axis thereof. The preferred embodiment of the present invention illustrated in the figures advantageously includes a hydraulic damper which is adjustable in terms of resistance to rotation of the central axle. More specifically, the hydraulic damper includes resistance adjustment wheel 38 which is rotatably mounted upon the upper surface 40 of adjustment plate 42 via studs 44, bushings 46 and nuts 241. Bushings and nuts are utilized to mount the adjustment plate to an intermediary plate 50 which, in turn, is affixed to the main damper housing 52 (along with, in certain preferred embodiments, additional bolts). The adjustment wheel comprises a gear, rotation of which, when the damper is assembled, causes rotation of valve adjustment pinion 48 which is also mounted upon the upper surface of the adjustment plate. More specifically, the adjustment wheel includes numerical indicators such as, for example, engraved or etched numbers running, for example, from 1 to 10, circumferentially along the superior surface 240 of the adjustment wheel. An indicator mark 54 is placed upon the outside surface of adjustment assembly cover 56 (which may also be referred to as the adjustment control housing) so that a user can rotate the adjustment wheel to a desired number setting. Rotation of the wheel, as mentioned above, causes a simultaneous rotation of the adjustment gear pinion 48 which, in turn, operates hydraulic flow valve 201 which restricts the movement of hydraulic fluid caused by motion of the vane 207. In preferred embodiments of the present invention, the adjustment wheel, pinion and valve are configured so that as the wheel is rotated in a direction resulting in higher numbers aligning with the indicator mark, the valve constricts flow of hydraulic fluid during rotation of the central axle. Such constriction results in greater resistance of central axle 36 against rotation—either clockwise or counterclockwise—. Since, as discussed above and below, the restrictor arm is mounted upon the central axle, increasing the numerical position of the adjustment wheel will cause greater resistance to rotation of the device by a user. More specifically, a user who has placed his elbow within the elbow cup lined with the elbow pad and has gripped the handgrip (all with the same arm) will need to utilize more force —at any given speed of operation—in attempting to inwardly or outwardly rotate his shoulder when higher adjustment numbers are selected. However, as also discussed above, regardless of the position of the adjustment wheel, attempting to operate the device with quicker movements will also generate greater resistance while, operating the device more slowly will result in less resistance. Thus, as discussed above, the adjustment wheel enables an increase or decrease in the range of resistance provided by the damper to operation of the actuator arm by a user.

As discussed above, the rotary hydraulic damper includes a rotor 205 upon which a fin 207 (which may also be referred to as a vane) extends. When the rotor turns, in response to turning of the central axle of the damper, the fin causes hydraulic fluid with the damper reservoir to flow therewithin. The reservoir, which is contained within and defined by housing 52, upper seal 209 (with gasket) and lower seal 211 (with gasket) is filled, for example, with a silicon hydraulic fluid. As discussed above, central axle 36 of the hydraulic damper extends through the base plate via axle bore 58 where it enters through the lower surface of the restrictor arm through lock bore 62, to engage and be affixed to the restrictor arm via lock screw 64 which engages lock screw bore 64' so as to allow the lock bore to tightly engage the central axle. The central axle is, as discussed above and below, is capable and intended to enable rotation of the restrictor and actuator arms. It thus forms the axis of rotation for an arcuate path 66 followed by the restrictor and the actuator arm 68 during use of the device. When the arms rotate through the above-described arcuate path, this motion, a reciprocating arc, is transferred, via the central axle, to the rotor. The rotation of the rotor causes the fin thereupon to propel hydraulic fluid through defined and constricted pathways formed by fins mounted upon and disposed radially (and inwardly from) the inner surface of the main housing. The resistance generated by forcing the hydraulic fluid through such constricted pathways provides the resistance to rotation of the actuator arm.

The restrictor arm 60 illustrated in the figures may be described as including a proximal terminus 70, a distal terminus 72 an upper surface 74, a lower surface 76 and two side surfaces 78 & 78'. The restrictor arm illustrated in the figures includes restrictor finger 80 extending from and continuous with the proximal terminus of the restrictor arm. The restrictor finger is shaped and configured so as to extend over an arcuate path 82 during rotation of the restrictor arm which said path lies directly above a series of restrictor pin bores 20 prepared, in a corresponding arch, in the base plate. The restrictor pin bores are configured to accept and retain restrictor pins which, as described above, are utilized to extend upward, above the upper surface of the base plate and intercept the arcuate pate of the restrictor finger, thus restricting the arcuate movement of the restrictor and actuator arm 68. It is preferred that the restrictor arm be formed of a high strength material such as aluminum, steel or alloys thereof. However, it is also contemplated that the restrictor arm may be formed of a composite plastic such as, for example, a carbon fiber reinforced plastic or a fiberglass material.

The actuator arm 68 illustrated in the figures is advantageously configured as an elongated bar having a proximal terminus 88, a distal terminus 90, a longitudinal axis extending therebetween, an upper surface 92 a lower surface 94 and two side surfaces 96 & 96'.

It is preferred that the actuator arm be formed of a high strength material such as, for example, steel, aluminum or alloys thereof. It is also possible to form the actuator arm from composite plastic materials such as carbon fiber reinforced plastic and fiberglass materials.

In the preferred embodiment of the present invention illustrated in the figures, side plates 98 & 98' are provided as a means of affixing the actuator arm to the restrictor arm. The side plates are configured as flat elongated plates having an inner and outer broad planar surface, an upper edge, a lower edge, a proximal terminus and a distal terminus. The side plates advantageously include a plurality of threaded bores 13 penetrating through the two broad planar side surfaces which are especially shaped and configured to enable alignment thereof within portions of the side surfaces of the restrictor arm to enable fixation therebetween.

Figure 14:
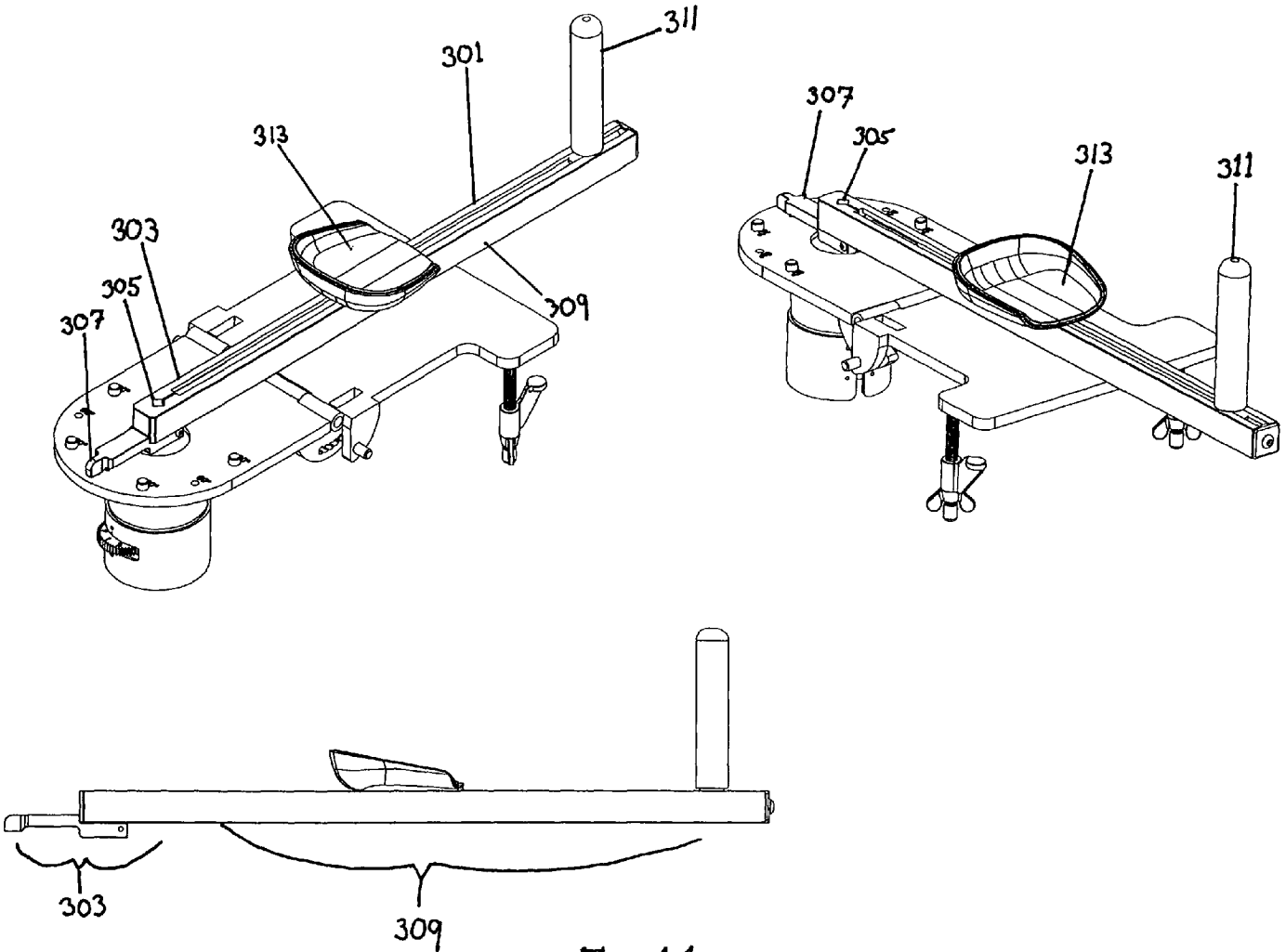
FIG. 14 is a right, left and side isometric top view of a first alternate embodiment of the present invention incorporating an operation arm.

In the embodiment illustrated in the figures, the inner broad surface of each side plate 98 & 98', is fitted within a side channel 190 and 190' formed within the side surfaces of the actuator arm. The threaded bores formed in the side plates are especially configured and arranged to align with assembly bores 21 formed along and through both side surfaces of the restrictor arms near the distal end thereof. By aligning the threaded bores 13 of the side plates placed within the side channels of the actuator arm with the assembly bores formed within the side surfaces of the restrictor arm and thence passing assembling bolts 15 through the assembly bores 21 so as to engage and tightly thread into the threaded bores 13 of the side plates, the proximal end of the actuator arm is rigidly affixed to the distal end of the restrictor arm in longitudinal alignment therewith. It is important to note that this—as well as all means of affixation between the actuator and restrictor arm in the present invention—is none pivoting and holds the actuator and restrictor arms in rigid longitudinal alignment. Such a configuration will not allow a change of angulation/elevation of one arm relative to the other. Both the restrictor and actuator arm are those held in a perpendicular relation to the axis of rotation provided by the central axle of the hydraulic damper. Since a rigid, non-pivoting affixation is required between the actuator and restrictor arms in the present invention, alternate embodiments of the present invention advantageously incorporate a single wherein the actuator arm is formed—as one continuous structure—with the restrictor arm as illustrated in FIG. 14. In such alternate embodiments the operation arm 301 includes, at a proximal portion, a restrictor section 303 which includes a lock bore 305 and a restrictor finger 307—in much the same configuration and arrangement as the preferred embodiment of the present invention. Likewise, the distal portion of the operation bar is formed as an actuator section 309 including an adjustable grip handle 311 and adjustable elbow cup 313—in the same basic arrangement as the preferred embodiment of the present invention. However, the alternate embodiment of the present invention utilizing a operation arm requires no means of affixing an actuator arm to a restrictor arm as such components are formed as one continues structure.

The exercise and rehabilitation device of the present invention provides for adjustment of the elevation of the actuator arm relative to the planar top surface of the distal section of the base plate and the surface upon which it is mounted via the incorporation of a pivoting two section base plate. In a preferred embodiment of the present invention, the proximal section of the base plate is pivotally joined to the distal section by means of a hinge joint located at the distal end of the proximal section and proximal end of the distal section of the two section base plate. The hinge joint may be advantageously formed utilizing, for example, a barrel hinge configuration. More specifically, and in regard to a first preferred embodiment of the present invention illustrated in the figures, the proximal section of the base is especially designed and configured to include two lateral pin receiving barrels 53 and 53' (a right and left lateral pin receiving barrel) especially positioned and formed for secure receipt and engagement of a hinge pin 55. The lateral pin receiving barrels are positioned at the distal end of the proximal section adjacent to the right and left sides thereof. There is sufficient space, medially, between the left and right pin receiving barrels so that, upon alignment of the distal end of the proximal section with the proximal end of the distal section, space is provided between the right and left receiving barrels for positioning of the central pin receiving barrel 57 described below.

The two lateral pin receiving barrels 53 and 53' are, in fact, hollow cylinders having a central bore running the full length of each such receiving barrel, the diameter of said bores being selected in order to enable a hinge pin to pass through the central bore of both lateral receiving barrels and be securely held therein. The distal section of the base plate is formed to include a central pin receiving barrel 57 located at the proximal end thereof and substantially centered between the left and right edges thereof. The central pin receiving barrel also demonstrating a central bore therewithin of equal dimension to that of the central bores of the lateral hinge receiving barrels. The distal section of the base plate of the present invention also advantageously includes a means for affixing the device to a surface such as, for example, a table top. In a preferred embodiment of the present invention, the distal section of the two piece base plate includes two screw clamps, substantially the same as those disclosed in the '191 application, in order to enable fixation of the device to a flat surface (such as a table top. The proximal section of the base plate is not fixed—directly—to a supporting surface, but rather is pivotally affixed to the distal section which may be affixed to such a supporting surface for use of the device.

The two lateral pin receiving barrels 53 and 53' formed at the right and left distal portions of the proximal section of the base plate and the central pin receiving barrel 57 of the distal section of the plate are designed, configured and positioned so that when the distal end of the proximal section is adjacent to the proximal end of the distal section—and the broad upper and lower planar surfaces of the two sections of the base plate are aligned along a horizontal plane—the central bores of all three pin receiving barrels align so as to enable receipt of a hinge pin 55 therethrough. The hinge pin, in turn, is selected to demonstrate a diameter that enables the pin to pass through each of the central bores of the receiving barrels while providing enough engagement therewith so as to resist loss of the pin from said receiving barrels. The length of the hinge pin is selected so that the pin will effectively pass through and remain within the full length of all of the receiving barrels so as to provide a pivot axis. This pivotal axis allows the proximal section of the two piece base plate to be pivoted relative to the distal section, so as to enable adjustment of actuator bar elevation (as discussed below).

In addition to the incorporation of a barrel hinge joint enabling the two section base plate to pivot, the preferred embodiment may also advantageously include an elevation adjustment and locking means. As discussed in more detail, below, in certain preferred embodiments of the present invention, the elevation adjustment and locking means comprises at least one elevation control plate, two elevation receiving pin plates and an elevation pin.

Although basic elevation adjustment of the present invention is provided by means of the above-described pivoting joint, it is further advantageous, although not required, that the present invention incorporate a means of—setting and locking in—a specific desired elevation of actuator arm operation. For this purpose, the elevation adjustment and locking means of the preferred embodiment enables the proximal section of the two piece base plate, when lowered relative to the distal section by means of the above-described hinge—to be set and locked at a specific angular relationship with the distal section of the base plate. This precise setting enables one to choose desired elevational angles of the restrictor arm and transfer arm.

When utilizing the device of the preferred embodiment, the distal section of the base plate can be, for example, securely affixed to a table top via the aforementioned screw clamps. When the planar surfaces (upper and lower) of both sections of the base plate are positioned along a single horizontal plane with one another, (at "0 degrees") the actuator arm, which is rigidly affixed to the restrictor arm, will lie parallel to the surface upon which the device is mounted. However, by operating the hinge joint, the proximal section of the base plate can be lowered to a desired angular relation relative to the distal section. The lowering of the proximal base plate will, in turn, enable an increase in elevation of the actuator arm relative to the upper and lower planar surfaces of the distal section of the base plate and the surface upon which the distal base plate is mounted. However, the arcuate motion of the actuator arm will remain in the same angular relationship (90 degrees) with the longitudinal axis of damper (central axle) rotation. Thus, such change in elevation will not cause a change in the amount of force needed to operate the actuator arm at any given speed.

In order to provide fixed elevation adjustments of the actuator arm relative to the distal portion of the base plate and the surface upon which it is mounted, in certain preferred embodiments of the present invention, the proximal and distal sections of the base plate are designed and configured to include an elevation control and locking means. In the preferred embodiment of the present invention illustrated in FIGS. 1-11, two elevation control plates 59 & 59' are affixed to the right and left lower surfaces of the proximal base plate in close proximity to the distal end thereof. However, the present invention also contemplates embodiments that utilize only one elevation control plate situated between the above and below discussed elevation pin mounting plates. The distal section of the two piece base plate, in turn, includes two control pin receiving plates 160 and 160' affixed to the right and left sides of the distal section of the base plate proximal to the proximal end thereof.

Each of the elevation control plates 59 and 59' includes, in a arcuate pattern, an elevation adjustment groove 61 wherein an arcuate groove is formed which includes a series of elevation lock bores 63 at selected positions along the groove. The arcuate groove and elevation lock bores formed therein are especially formed so that when the distal section of the base plate is mounted upon a surface, the pivoting articulation provided by the above-described barrel hinge joint will coincide with and enable movement of the below described elevation pin within the arcuate path defined by the elevation groove. More specifically, the elevation lock bores may be formed and positioned along the elevation adjustment grooves so that when, as described below, the proximal section of the base plate is pivoted, and the elevation bore locks are positioned within selected lock bores, the elevation of the actuator arm may be set at specific, desired angles of elevation. For example, the lock bores may be placed and positioned so as to enable the device to be set and locked at an elevation of 0, 11, 22, 33 and 45 degrees. In fact, the number and positions of such lock bores can be configured so as to provide any desired elevation. Two elevation control plate pass through slots 180 an 180' are formed in the proximal portion of the distal section of the base enable, as the proximal plate pivots downward, the elevation control plate to pass through the slots so as to provide unhindered pivoting motion of the base plate.

The exercise and rehabilitation device of the present invention also includes an elevation pin 65. In regard to the first preferred embodiment of the present invention shown in the figures, the elevation pin is formed and configured an elongated rod having two barrel-like enlarged portions—elevation bore locks—267 located thereupon. The diameter of the pin at the elevation bore lock is slightly less than that of the elevation lock bores 63 formed along the elevation groove. Such dimensions enable, as discussed below, the elevation pin two slide laterally while the elevation bore locks 267 formed thereupon engage and fit securely within the elevation lock bores formed along the arcuate path of the elevation grooves. In certain alternate embodiments of the present invention which incorporate only one elevation control plate, the elevation pin includes only one elevation bore lock.

At one end of the elevation pin, the pin is formed to include a control button 73 which exhibits a substantially greater diameter than the elevation pin. The opposite end of the elevation pin does not include such a control button. This end of the elevation pin is especially formed to engage with and be biased against an elevation spring. More specifically, that end of the elevation pin opposite the control button fits within the bore of an elevation pin receiving plate which includes, in axial alignment with an elevation pin receiving bore formed therein, a pin receiving cap 67. Within the cap, an elevation pin control spring 69 is housed. This spring acts to bias inwards against that end of the elevation spring opposite the end which includes the control button. Thus, the elevation spring biases against the elevation pin and tends to push it inward in the direction of the opposite elevation pin receiving pin receiving plate in which the control button operates.

In the preferred embodiment illustrated in the figures, the elevation pin mounting plate 160', located at the opposite side (left) side of the proximal plate receives that end of the elevation pin which includes the control button 73. A bushing 71 is provided so as to slideably affix the control button end of the elevation pin within this elevation pin mounting plate while preventing loss of the pin due to the biasing action of the elevation spring. For this purpose, the control button 73 may be affixed to the elevation mounting plate 160' by, for example, control bushing 71. In preferred embodiments of the present invention, the control bushing may be advantageously formed to include a central bore through which the button may pass laterally (outward, away from the longitudinal axis of the device) until reaching a terminal lateral position. At this position, a ring like rib formed circumferentially near the medial end of the control button may engage, for example, a crimped portion of the bushing adjacent the lateral end thereof. The control bushing thus acts to retain the control button in place when lateral displacement of the pin, provided by the elevation pin spring causes the pin to reach a maximum lateral position In the preferred embodiment illustrated in the figures, the elevation pin 65 is configured and formed so that when the pin is displaced to its maximum lateral position (by action of the elevation spring) the enlarged barrel like portions of the pin—the elevation bore locks 267 align with the elevation lock bores formed in the elevation grooves. When the button is depressed inwards (medially—towards the longitudinal axis of the device) the elevation bore locks move out of the bores so that the elevation pin may allow the two section base plate to pivot (the elevation pin now being able to pass along the arcuate path of the elevation slot.) Simply put, the reduced diameter of the elevation pin adjacent to the elevation bore locks enables full articulation of the hinge joint formed between the proximal and distal sections of the base plate. Release of the elevation pin button when the barrels are aligned with an elevation bore formed in the elevation groove locks the relationship (the elevation) in a set position. Thus, a user may adjust the relative elevation of the actuator arm by depressing the control button and thereafter pivoting the proximal section of the base plate via the hinge mechanism to obtain a desired angle. Thereafter, releasing the pin locks the relationship of the proximal section of the base plate—upon which the restrictor and actuator arm are mounted—so as to provide a desired elevation. Since the actuator arm and restrictor arm are longitudinally aligned in a fixed relationship, and since the central axle of the damper is mounted perpendicular to the upper and lower surfaces of the proximal section of the base plate, damper and actuator arm move in unison. Such unison movement maintains the angular relationship between the arcuate path of the actuator arm and the longitudinal axis of rotation. This stable angular relation ensures that changing the elevation of the actuator arm utilizing the device of the present invention will not effect the amount of force necessary to operate the actuator arm at any given speed.

As discussed above and below, when the device is utilized, a user's elbow lies in an elbow cup 25 and a user's hand grasps a handgrip 41 both of which are mounted upon and extend upward from the upper surface of the actuator arm. With a user grasping the device in this manner, changes in actuator arm elevation cause the angle of the user's forearm and upper arm to change. Elevation adjustments enable a user to set the angle between the upper and lower arm at a desired position or a position as determined by a therapist. In addition, in many instances it is preferable that the user's shoulder directly overly (be plum with) the axis of rotation of the device. In instances where the device is mounted at a height too great, in relation to the user's shoulder, the user's elbow and the angle of rotation will be relatively forward of the shoulder. Increasing actuator elevation is useful in improving this relation.

The elbow cup of the present invention is especially configured and adapted for comfortable and secure placement of a user's elbow therewithin. The elbow cup utilized in the embodiment illustrated in the figures is comprised of an elbow cup shell 25 and an elbow cup insert 27. More specifically, in the preferred embodiment illustrated in the figures, elongated bolt receiver 29 is a flattened and elongated bolt receiver especially shaped and configured to be slideably inserted inside adjustment channel 31 (after removal of bolt 33 and plate 35). Elbow cup shell 25 is placed over channel 31 and thereafter the two bolt bores 37 especially shaped and configured to enable receipt of bolts 39 which are aligned with corresponding threaded bores prepared within the upper surface of elongated bolt receiver 29. Thereafter, the bolts 39 are passed through the elbow cup shell bores so as to matingly engage the threaded bores of the elongated bolt receiver. Thereafter, the position of the elbow cup may be adjusted fore and aft (towards the distal or proximal terminus of the actuator bar, so as to position the elbow as desired and fixed in this position by tightening the bolts. The elbow cup shell provides strength and stability and thus is formed of any suitable material demonstrating sufficient support and rigidity for containment and support of a user's elbow during use of the subject device. Therefore, the elbow cup shell may be formed of a metal or metal alloy such as, for example, aluminum, steel and alloys thereof. In addition, the elbow cup shell may be formed of a thermoplastic material such as a polystyrene, polyvinylchloride, polyester, polycarbonate, polyether or polyurethane plastic. In addition, composite plastics may be utilized. In order to increase user comfort and to improve elbow positional stability an elbow cup insert 27 is fitted to the superior surface of the elbow cup shell and is generally formed from a resilient, pliable material. For example, the insert may be formed of a foam material including open or closed cell foam. The foam may be selected to be a polyurethane, polyethylene or polypropylene rubber foam polyurethane material. In addition, the elbow cup insert may be formed of a natural or synthetic rubber compound. In addition, the elbow cup insert may advantageously be comprised of or include a gel compound utilized for their pressure-distributing characteristics such as, for example, gels based upon polyvinyl chloride, polyorganosiloxanes and polyurethane.

Likewise, the hand grip 41 is shaped adapted and configured for secure grasping by a user's hand. The handgrip may be formed from the same materials, discussed, above, in regard to the elbow cup shell. However, whatever material is utilized to form the handgrip, the material must demonstrate sufficient strength so as to avoid shearing during use. It is also preferred that, in some preferred embodiments of the present invention, that the hand grip include, as an outer layer, a resilient cover formed from the same materials discussed above in regard to the elbow cup insert. Such materials provide superior comfort and enable a user to better grip the handle as such materials include sufficient plasticity to enhance grip.

In the preferred embodiments illustrated in the figures, the handgrip is affixed and positioned along the actuator arm distal to the position of the elbow cup. Both the elbow cup an handgrip are mounted to, positioned upon and extend upward from the the upper surface of the actuator arm. The present invention utilizes adjustable mounting for both the elbow cup and hand grip. For this purpose, the upper surface of the actuator arm may be configured (as described above) to include an adjustment channel 31 along which both the hand grip and elbow cup may be moved along the length of the actuator arm. For example, the hand grip may be moved distally (towards the distal terminus of the actuator arm) to accommodate forearms of greater length. Likewise, the handgrip may be moved proximally (towards the proximal terminus of the actuator arm) so as to accommodate shorter forearms. As used throughout this specification and within the claims, the term "moved distally" is equivalent to "moved fore" and the term "moved proximally" is equivalent to "moved aft". Thus, it may also be said that both the hand grip and elbow cup are mounted, in preferred embodiments, in a manner which allows movement of both a fore and aft direction. Any adjustable fastener such as, for example, a T bolt 43 with washer 45 may be utilized to affix the hand grip to a desired position along the superior surface of the actuator arm. For this purpose, the head of T bolt 43 demonstrates a dimension greater than the width of the adjustment channel 31 so as to prevent the head from slipping through the channel and releasing the handle. More specifically, in the embodiment illustrated, the T bolt is introduced into the channel, at the distal end of the actuator arm, by removing actuator plate 35 which is retained by plate bolt 33. Once introduced into the channel, with the bolts head oriented downward and the free threaded end extends upwards, through the channel formed in the upper surface of the actuator bar. Thereafter, the bolt passes through washer 45 and then enters the inferior end of the hand grip 41 which includes a threaded bore 47 formed therein for engagement of the bolt. Therefore, upon engagement of the bolt by rotation of the handle, the handle may be tightened at any desired point along the length of the actuator arm by simply sliding the handle to the desired position and thereafter further rotating the handle so that the washer and bolt firmly engage the track. In the embodiment illustrated in the figures, the elbow cup is affixed to the upper surface of the actuator bar via two bolts 39 at a desired position within the channel. Ordinarily, the elbow cup is positioned so that an elbow placed therein is adjusted to closely overly the axis of arcuate motion (and the central axle that forms this axis). However, due to varying dimensions, the distance between the user's elbow and hand is accurately accommodated by adjusting the position of the handgrip. Although, in most instances, the elbow cup will remain close to alignment with the rotational axis, special circumstances including, but not limited to special therapeutic needs and unusual physical dimensions may require some adjustment of the position of the elbow pad.

The terms and expressions which have been employed in the foregoing specification and in the abstract are used therein as terms of description and not limitation, and there is no intention, in the use of such terms and expressions, of excluding equivalents of the features shown and described or portions thereof, it being recognized that the scope of the invention is defined and limited only by the following claims.

We claim:

1. A highly portable shoulder rehabilitation/exercise device comprised of a two section base plate, a hydraulic damper, a restrictor arm, an actuator arm, an elbow cup and a hand grip wherein:

the two section base plate comprises a proximal and distal section, each such section having a proximal end, a distal end, a planar upper and lower surface which are parallel to one another, the proximal section of the base plate including a plurality of restrictor bores especially configured and adapted for the receipt of restrictor pins, the proximal section of the base plate also including an axle bore especially configured and adapted for receipt and passage of a central axle of the hydraulic damper through the lower and upper surface thereof, the distal section base plate further including a means for affixing the device to a stable surface, the proximal and distal sections of the base plate being pivotally affixed to one another so that the angular relationship between the planar surfaces of the proximal and distal sections of the base plate may be changed thereby;

the hydraulic damper is mounted to the planar lower surface of the proximal section of the base plate and comprises a main damper housing, the central axle, hydraulic fluid, a means for propelling the hydraulic fluid and a hydraulic fluid flow valve having an aperture, the restrictor arm includes an upper surface, a lower surface, two side surfaces, a proximal and distal terminus with a longitudinal axis extending therebetween, the restrictor arm including a lock bore for receipt of the central axle of the hydraulic damper which provides an axis of rotation for arcuate motion of the restrictor and actuator arm, the restrictor arm further including a restrictor finger extending from and continuous with the proximal terminus of the restrictor arm, the restrictor arm further including, adjacent the distal terminus thereof, a means for rigidly affixing the actuator arm to the restrictor arm so that the actuator arm and restrictor arm align along a single longitudinal axis;

the actuator arm is configured as an elongated bar having a length, an upper surface, a lower surface, two side surfaces and a proximal and distal terminus with a longitudinal axis extending therebetween, the hand grip and the elbow cup being adjustably mounted and extending upward from the upper surface of the actuator arm, the hand grip being mounted distal to the elbow cup;

the elbow cup is shaped and configured to adapt to and engage the elbow of a user and wherein the elbow cup is mounted to the actuator arm in such a manner so as to allow the elbow cup to be moved fore and aft along the length of the actuator arm so as to obtain a desired position; and the hand grip is shaped and configured to facilitate a user grasping said grip and is mounted upon the actuator arm in such a manner as to allow the hand grip to be moved fore and aft along the length of the actuator arm, so as to obtain a desired position; wherein when an elbow and hand of one of a user's arms are positioned so that the elbow is positioned within the elbow cup and the hand grasps the hand grip, and, thereafter, the user laterally biases the actuator arm in an inward and outward direction, the actuator arm and the restrictor arm to which it is affixed move along an arcuate path, the device thereby guiding the user's arm in such a manner as to enable performance of both internal and external rotations of the shoulder without adjusting the device or changing the user's position, and wherein, placement of restrictor pins, within the one or more restrictor pin bores, enables a user to define and limit the range of motion of the arcuate path; the hydraulic damper, upon which the restrictor arm is mounted, providing smooth, fluid-like resistance to said internal and external rotations of the shoulder which said resistance increases and decreases, automatically in accordance with speed of operation; the pivoting affixation of the proximal and distal sections of the base plate enabling adjustment to the elevation of a user's forearm so as to attain a desired angular relationship between a user's shoulder, upper and lower arm while also enabling the device to be utilized while mounted upon surfaces of varying heights.

2. The highly portable shoulder rehabilitation/exercise device of claim 1 wherein the mean for affixing the device to a stable surface comprises at least two screw clamps mounted upon the distal section of the base plate.

3. The highly portable shoulder rehabilitation/exercise device of claim 2 wherein the screw clamps are comprised of a threaded stud, a sliding clamp and a wing nut for adjustment of said sliding clamp.

4. The highly portable shoulder rehabilitation/exercise device of claim 3 wherein the distal section of the base plate includes two lateral extensions formed at the distal end thereof, each of said extensions having a bore formed therein for receipt of the threaded stud which extends from the lower surface of said base plate at said lateral extensions.

5. The highly portable shoulder rehabilitation/exercise device of claim 1 wherein the two sections of the base plate are pivotally affixed to one another by means of a barrel hinge joint.

6. The highly portable shoulder rehabilitation/exercise device of claim 5 wherein the barrel hinge joint is comprised of two lateral pin receiving barrels, one central pin receiving barrel and a hinge pin.

7. The highly portable shoulder rehabilitation/exercise device of claim 6 wherein the device further includes an elevation control and locking means for setting and locking the angular relationship between the planar surfaces of the two section base plate.

8. The highly portable shoulder rehabilitation/exercise device of claim 7 wherein the elevation control and locking means for setting and locking comprises at least one elevation control plate having an elevation groove formed therein and a plurality of elevation lock bores formed along an arcuate path defined by said elevation groove, at least two elevation pin receiving plates and an elevation pin.

9. The highly portable shoulder rehabilitation/exercise device of claim 8 wherein the elevation pin includes at least one elevation bore lock which is especially configured and adapted to engage a selected elevation lock bore.

10. The highly portable shoulder rehabilitation/exercise device of claim 7 wherein the elevation control and locking means comprises two elevation control plates having an elevation groove formed therein and a plurality of lock bores formed along an arcuate path defined by said elevation groove , two elevation pin receiving plates and an elevation pin.

11. The highly portable shoulder rehabilitation/exercise device of claim 10 wherein the elevation pin includes two elevation bore locks.

12. The highly portable shoulder rehabilitation/exercise device of claim 10 wherein the actuator arm and restrictor arm are formed as one continuous arm.

13. The highly portable shoulder rehabilitation/exercise device of claim 1 wherein the means for propelling the hydraulic fluid is selected from the group consisting of pistons, vanes and fins.

14. The highly portable shoulder rehabilitation/exercise device of claim 1 wherein the hydraulic damper further includes a means for manually adjusting resistance to arcuate motion provided thereby.

15. The highly portable shoulder rehabilitation/exercise device of claim 13 wherein the means for manually adjusting the resistance to arcuate motion provided by the hydraulic damper comprises an adjustable hydraulic flow valve and adjustment wheel utilized to control the aperture of said valve.

16. The highly portable shoulder rehabilitation/exercise device of claim 1 wherein the device further includes two side plates as a means for rigidly affixing the actuator arm to the restrictor arm.

17. The highly portable shoulder rehabilitation/exercise device of claim 15 wherein the side plates are configured as flat elongated plates having two broad planar surfaces, an upper edge, a lower edge, a proximal terminus and a distal terminus and include a plurality of threaded bores penetrating through the two broad planar side surfaces which are especially shaped and configured to enable insertion into side channels formed within the side surfaces, the actuator arm and the restrictor arm include bores which correspond to and align with the plurality of bores of the side plates.

18. The highly portable shoulder rehabilitation/exercise device of claim 1 wherein the base plate includes an arcuate pattern of the restrictor bores located within the base plate at positions corresponding to 0, 30, 60 and 90 degrees of inward and outward rotation of the restrictor arm.

* * * * *